US011891831B1

(12) United States Patent
Hudson et al.

(10) Patent No.: US 11,891,831 B1
(45) Date of Patent: Feb. 6, 2024

(54) INFILL-COVERED BARRIER

(71) Applicant: Ameristar Perimeter Security USA Inc., Tulsa, OK (US)

(72) Inventors: Bryan L Hudson, Mounds, OK (US); Michael L. Bishop, Bristow, OK (US)

(73) Assignee: Ameristar Perimeter Security USA Inc., Tulsa, OK (US)

( * ) Notice: Subject to any disclaimer, the term of this patent is extended or adjusted under 35 U.S.C. 154(b) by 908 days.

(21) Appl. No.: 16/512,436

(22) Filed: Jul. 16, 2019

Related U.S. Application Data

(60) Provisional application No. 62/699,006, filed on Jul. 17, 2018.

(51) Int. Cl.
*E04H 17/14* (2006.01)
*E04H 17/16* (2006.01)

(52) U.S. Cl.
CPC ..... *E04H 17/1417* (2013.01); *E04H 17/1488* (2021.01); *E04H 17/16* (2013.01); *E04H 17/1473* (2021.01)

(58) Field of Classification Search
CPC ..... E04H 17/1417; E04H 17/1447; E04H 17/1448; E04H 17/1452; E04H 17/146; E04H 17/1473; E04H 17/1488; E04H 17/16; E04H 17/1602; E04H 17/161; E04H 17/163; E04H 17/17; E04F 11/1834; E04F 11/1836; E04F 2011/1821; E04F 2011/1827; E04F 2011/1868; F16B 5/008; F16B 5/0028; F16B 2005/0678; Y10T 403/5733; Y10T 403/5741
See application file for complete search history.

(56) References Cited

U.S. PATENT DOCUMENTS 1,783,196 A * 12/1930 Purdy ..... E04H 17/1426 52/674
1,867,816 A * 7/1932 Finkbeiner ..... E04H 17/1447 256/12.5

(Continued)

FOREIGN PATENT DOCUMENTS

CA 2428277 A1 * 11/2003 ..... E04H 17/161
CA 2412253 A1 * 5/2004 ..... E04H 17/161

(Continued)

*Primary Examiner* — Amber R Anderson
*Assistant Examiner* — Kevin J Baynes
(74) *Attorney, Agent, or Firm* — Gary Peterson

(57) ABSTRACT

A barrier is formed from a framework of posts and rails. Infill sections cover openings in the framework. Post brackets connect posts to rails. Each post bracket includes a collar and an attached holder. The collar is positioned over a post and lowered to a level where a rail is to be attached. The rail is secured within the holder. The holder and the collar are relatively rotatable. Adjacent rails in the barrier are interconnected end-to-end by adapters plugged into the hollow end of each rail. The adapters overlap, and are pinned together, permitting relative rotation between rails. Relative rotation of components permits barrier slope adjustment. Exposed vertical lateral edges of infill sections are covered by an elongate edge protection band having a central ridge and a pair of side recesses. An exposed edge portion of an infill section is received within the recess and clamped against the framework.

8 Claims, 22 Drawing Sheets

(56) References Cited

U.S. PATENT DOCUMENTS 4,303,226 A * 12/1981 Powell ..... E04H 17/161 256/25
4,398,840 A 8/1983 French
4,505,609 A 3/1985 Vella
4,616,950 A * 10/1986 Morris ..... F16B 7/048 403/231
4,899,991 A 2/1990 Brunkan
5,141,207 A 8/1992 Meglino
5,438,795 A * 8/1995 Galbraith ..... A01G 17/06 256/48
5,556,080 A * 9/1996 Vise ..... E04H 17/003 248/74.5
5,575,580 A 11/1996 Parrish
5,638,917 A * 6/1997 Vennen ..... E04G 3/20 182/150
5,961,242 A * 10/1999 Leone ..... E04H 17/1417 403/234
6,173,945 B1 * 1/2001 Lindsey ..... E04H 17/1413 256/24
6,386,519 B1 5/2002 Priefert
6,565,069 B2 5/2003 Morris
6,666,298 B2 * 12/2003 Volkman ..... E04G 3/20 182/82
6,679,482 B2 * 1/2004 Allenbaugh ..... E04G 21/3233 182/113
6,802,495 B1 10/2004 Schmidt
6,935,623 B2 8/2005 Cook
7,571,897 B2 * 8/2009 Heinz ..... E04H 17/20 256/DIG. 5
7,628,386 B2 * 12/2009 Payne ..... E04H 17/161 256/47
8,631,551 B1 * 1/2014 Payne ..... E04H 17/1417 29/428
8,783,661 B1 * 7/2014 Payne ..... E04H 17/168 256/49
8,834,057 B2 * 9/2014 Adams, Jr. ..... F16B 7/00 403/233
8,910,925 B2 * 12/2014 Payne ..... E04H 17/24 256/25
9,115,506 B2 * 8/2015 Hill ..... E04H 17/1417
9,309,690 B1 4/2016 Payne
9,428,934 B1 8/2016 Payne
9,512,633 B2 12/2016 Marron
9,518,404 B2 * 12/2016 Volin ..... E04H 12/2269
9,657,496 B1 5/2017 Payne
9,885,197 B2 2/2018 Pettlon, II
9,909,337 B1 * 3/2018 Moreno ..... E04H 17/20
10,527,223 B2 * 1/2020 Fruh ..... F16M 13/02
10,604,962 B1 * 3/2020 Givens ..... E04F 11/1855
10,689,866 B2 * 6/2020 Baca ..... E04G 21/3233
10,968,637 B2 4/2021 Eves
11,047,149 B1 * 6/2021 Fakhari ..... E04H 12/2253
D929,610 S * 8/2021 Xue ..... F16M 13/02 D25/126
2003/0164488 A1 9/2003 Terrels
2003/0209701 A1 * 11/2003 Goddard ..... E04H 17/161 256/47
2006/0033093 A1 2/2006 Lo
2008/0173855 A1 * 7/2008 Garrity ..... E04H 17/16 256/26
2008/0173856 A1 * 7/2008 Payne ..... E04H 17/168 29/525.02
2009/0321701 A1 * 12/2009 Payne ..... E04H 3/08 256/57
2014/0191177 A1 7/2014 Bailie
2015/0252941 A1 9/2015 Sirkin
2018/0371789 A1 * 12/2018 Moore ..... E04H 17/20

FOREIGN PATENT DOCUMENTS

DE 102016101127 A1 7/2017
EP 1002910 A2 5/2000
EP 1167658 A2 1/2002
EP 1564351 A1 * 8/2005 ..... E04H 17/161
EP 3546678 A1 * 10/2019 ..... E04H 17/161
FR 2611793 A1 * 9/1988 ..... E04H 17/161
FR 2896282 A1 * 7/2007 ..... E04H 17/1452
FR 2978780 A1 2/2013
FR 2983503 A1 6/2013
FR 3050221 A1 * 10/2017 ..... A01M 29/30
GB 2466778 A * 7/2010 ..... E04H 17/161
GB 2509195 A * 6/2014 ..... E04H 17/20
GB 2570912 A * 8/2019 ..... E04H 17/14
KR 20120006245 A * 1/2012 ..... E04H 17/20
WO 2004042165 A1 5/2004
WO WO-2009030000 A1 * 3/2009 ..... E04H 17/161
WO WO-2011004337 A2 * 1/2011 ..... E04H 17/161

* cited by examiner

INFILL-COVERED BARRIER

SUMMARY OF THE INVENTION

A post bracket is formed from a collar and a channel-shaped holder. The collar is configured to fittingly surround a post, and bounds an interior region within which a post is receivable. The collar is configured to closely receive a rail, is supported by the collar, and is rotatable with respect to the collar.

A kit is formed from a plurality of hollow rails and a plurality of adapters. Each rail has an end. Each adapter is formed from a base, a plug element and a flat lug. The base has opposed first and second sides. The plug element extends from the first side of the base, and is closely but clearingly receivable within the end of one of the rails. The lug extends from the second side of the base.

A kit is formed from a plurality of elongate rails and a plurality of rail brackets. Each rail bracket is formed from a seat and first and second arms. The seat has opposed first and second ends and opposed upper and lower sides, and is stably positionable atop one of the rails. The first arm extends from the first end of the seat adjacent its upper side. The second arm extends from the second end of the seat adjacent its lower side.

A kit is formed from a plurality of frame components, a plurality of infill sections, and a plurality of fasteners. The frame components are assemblable into a framework. Each infill section is configured to cover all or part of one or more openings in the framework. Each fastener includes an enlarged head, an elongate shaft projecting from the head, and an annular washer. The washer is positionable beneath the head, and has teeth formed thereon.

An edge protection band features a flat and elongate base having opposed first and second sides. An elongate and centrally disposed ridge is formed on the first side. First and second recesses are also formed on the first side of the base, on opposite sides of the ridge. Each recess is elongate, open and bounded only by the base and the ridge.

BRIEF DESCRIPTION OF THE DRAWINGS

FIG. 8 is a back elevation view of the post bracket shown in FIG. 7, taken along line 8-8.

FIG. 9 is a side elevation view of the post bracket shown in FIG. 5, similar to FIG. 6 but with the holder in a tilted position. The pivot element is shown.

FIG. 13 is a perspective view of an adapter.

FIG. 26 is a side elevation view of the rail bracket shown in FIG. 25, taken along line 26-26.

FIG. 31 is a side elevation view showing a rail bracket that has been partially attached to a raised infill section. The rail bracket is positioned above the uppermost rail in the framework.

FIG. 32 is a side elevation view showing the assembly of FIG. 31 after the infill section has been lowered and the seat of the rail bracket rests atop the rail.

FIG. 33 is a side elevation view showing the assembly of FIG. 32 after a second fastener has been installed on the rail bracket.

FIG. 34 is a perspective view of the assembly shown in FIG. 33.

DETAILED DESCRIPTION

Figure 1:
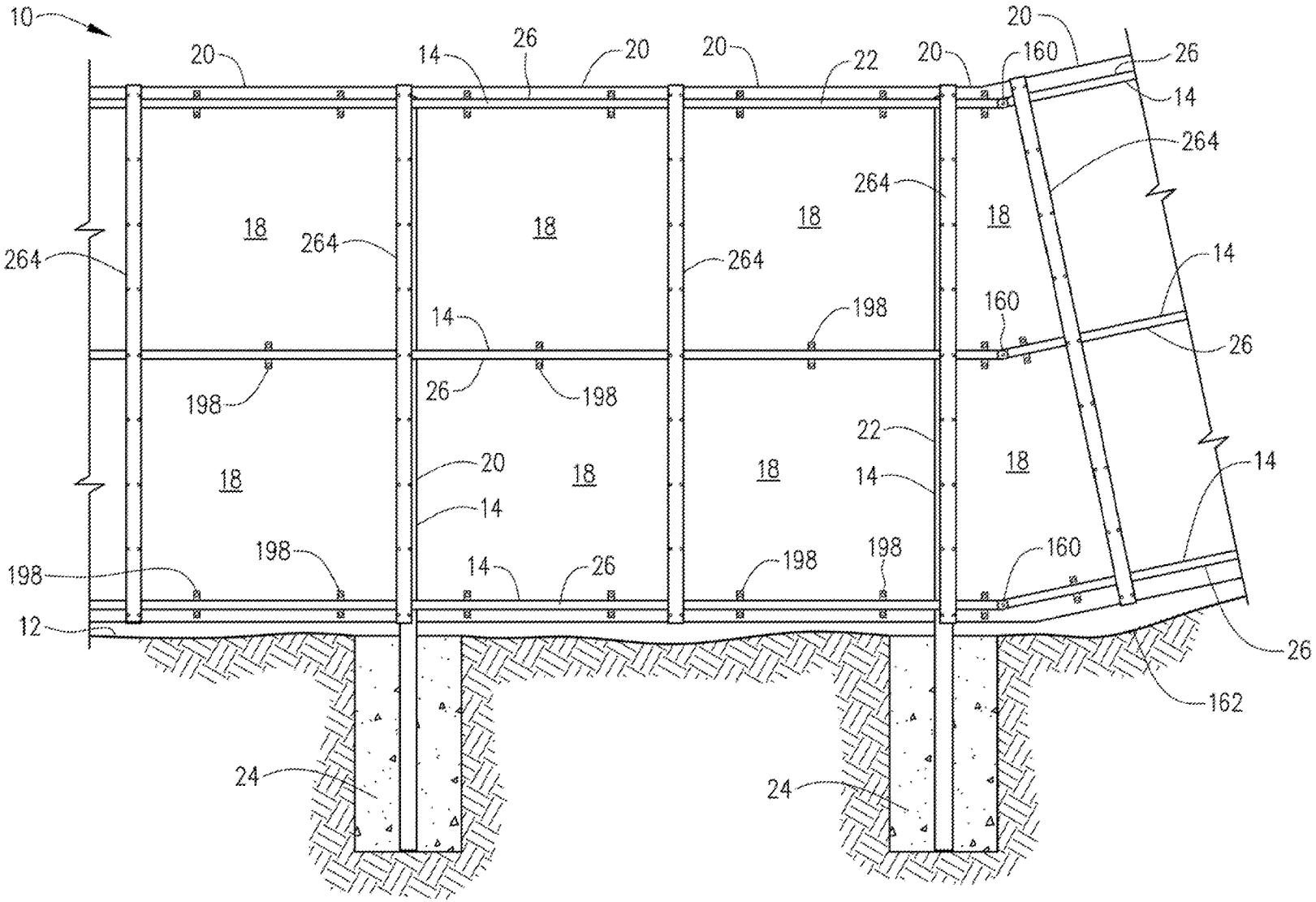
FIG. 1 is a front elevation view of a barrier. The terrain and footings are shown in cross-section.

FIG. 1 illustrates a barrier 10 formed on a terrain 12. The barrier 10, which may comprise a fence, is formed from a plurality of frame components 14 that are assembled to form a framework 16. The assembled frame components 14 bound a plurality of openings 18 within the framework 16. A plurality of infill sections 20 are supported by the framework 16, and collectively cover the openings 18.

The frame components 14 comprise a plurality of elongate posts 22, which are preferably identical in size, shape and construction. Each post 22 is preferably tubular and formed as a single piece of material. Also preferably, each post 22 has a uniform and rectangular cross-sectional profile, which may be square.

In one embodiment, each post 22 has a rectangular cross-sectional profile, with a major side width of 6 inches and a minor side width of 3 inches. In another embodiment, each post has a square cross-sectional profile. The side width of the square may be 4 inches, 6 inches or 8 inches.

Each post 22 is embedded at and adjacent one of its ends within a footing 24 that is in turn embedded within the terrain 12. The footing 24 is preferably formed from a ballast material, such as concrete. The maximum depth of the footing 24 should be at least 3 feet, and may be as much as 5 feet. In the assembled configuration of the barrier 10, each of the posts 22 extends vertically.

The posts 22 are situated along the boundary of the area to be enclosed by the barrier 10. The spacing of the posts 22 should be adequate to impart strength to the barrier 10, and to securely anchor other barrier components. In one preferred embodiment, adjacent posts 22 are separated by a distance of about 8 feet. In another embodiment, adjacent posts 22 are separated by a distance of about 10 feet.

The above-ground height of each installed post 22 is preferably substantially greater than the height of a human or other intruder. Preferably, each post 22 has an above-ground height of at least 8 feet, and a below-ground run of at least 3 feet. In one set of embodiments, the above-ground height of each post 22 is chosen at either 8 feet, 10 feet or 12 feet. In the same embodiment, the below-ground run of each post 22 is 3 feet. To protect against moisture, each post 22 may be provided with a solid cap at its upper end.

The frame components 14 further comprise a plurality of elongate rails 26, which are preferably identical in size, shape and construction. Each rail 26 is preferably hollow and formed as a single piece of material. Also preferably, each rail 26 has a uniform and rectangular cross-sectional profile, which most preferably is square.

In one embodiment, each rail 26 has a square cross-sectional profile, with a side width of 2 inches. In another embodiment, each rail 26 has a side width of 2.5 inches.

Each rail 26 is supported by one or more of the posts 22, and extends in transverse relationship to these posts 22. The length of each rail 26 should be at least sufficient to span the distance between an adjacent pair of posts 22. In some embodiments, a rail 26 may be twice as long, or three times or more as long, as the distance between a pair of adjacent posts 22. In one embodiment, the length of each rail 26 is about 24 feet. At least two, and preferably three or more rails 26 are supported by each of the posts 22 forming the barrier 10. Preferably, these rails 26 extend in parallel relationship.

When a rail 26 forming the barrier 10 either traverses a post 22, or terminates at a post 22, that rail 26 is preferably supported by a post bracket installed on that post 22. When the terrain 12 is flat, a post bracket 28 is used. The post brackets 28 included in the barrier 10 are preferably identical in size, shape and construction. One such post bracket 28 is shown in FIGS. 2 and 3.

Each post bracket 28 comprises a band 30 that is configured to fittingly surround the post 22 upon which it will be installed. The band 30 is preferably formed from a narrow and elongate strip of material having an opposed pair of ends 32. The band 30 has an internal surface 34 and an opposed external surface 36. The internal surface 34 bounds an interior region 38 of the band 30 within which a post 22 is receivable.

A flat end tab 40 is formed at each end 32 of the band 30. The end tabs 40 project outside the interior region 38, are separated by a gap 42, and are preferably disposed in parallel and face-to-face relationship. A fastener opening 44 is formed in each end tab 40, preferably away from any of its edges.

Figure 2:
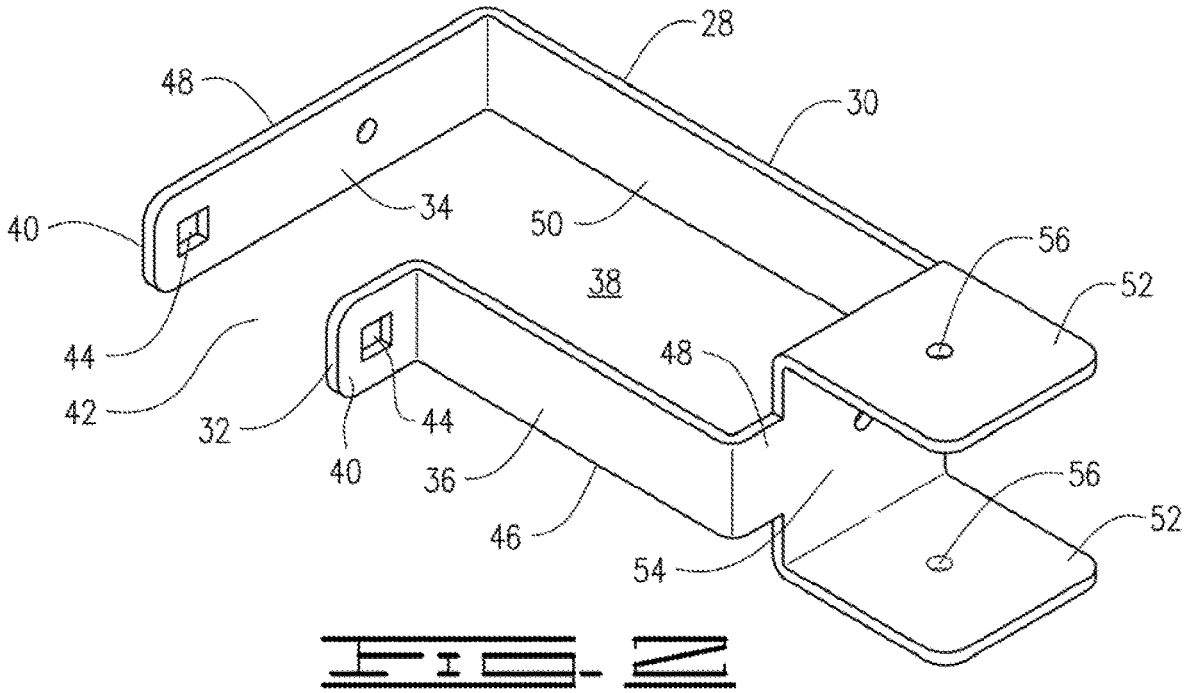
FIG. 2 is a perspective view of a post bracket of a type used on flat terrain.
Figure 3:
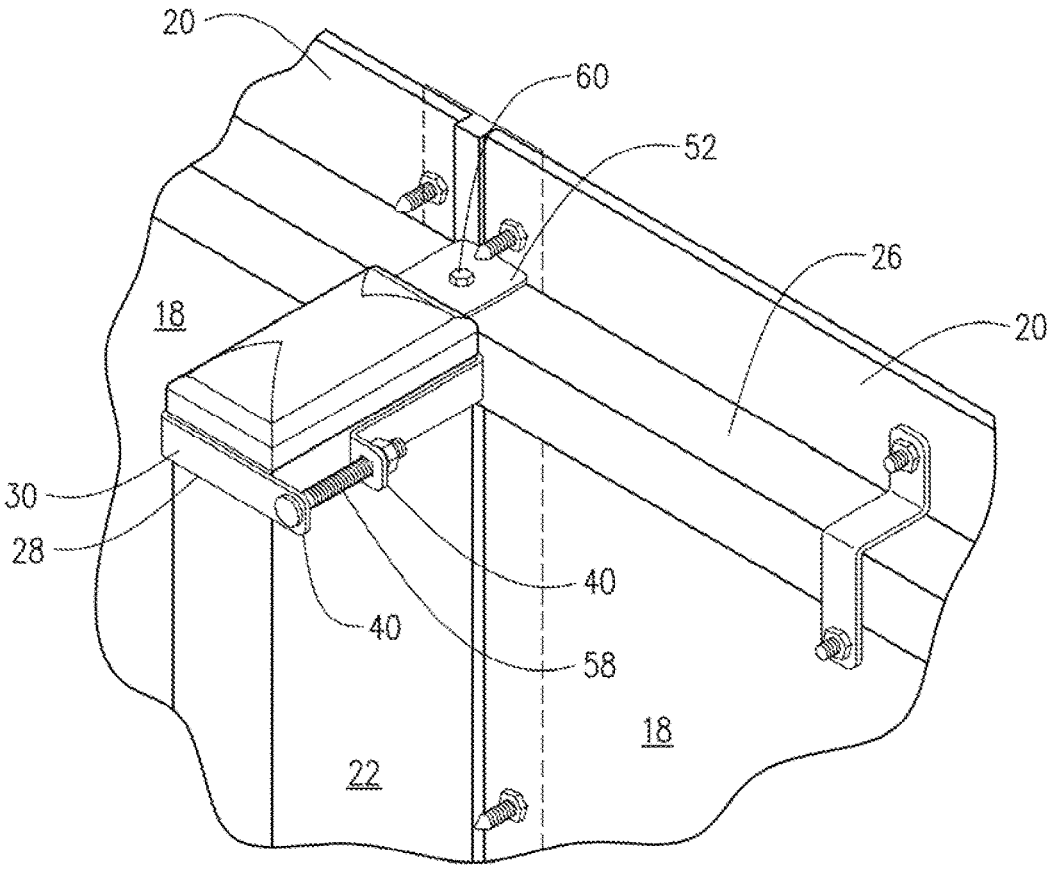
FIG. 3 is a perspective view of the post bracket shown in FIG. 2, in an assembled configuration within a portion of a barrier.
Figure 4:
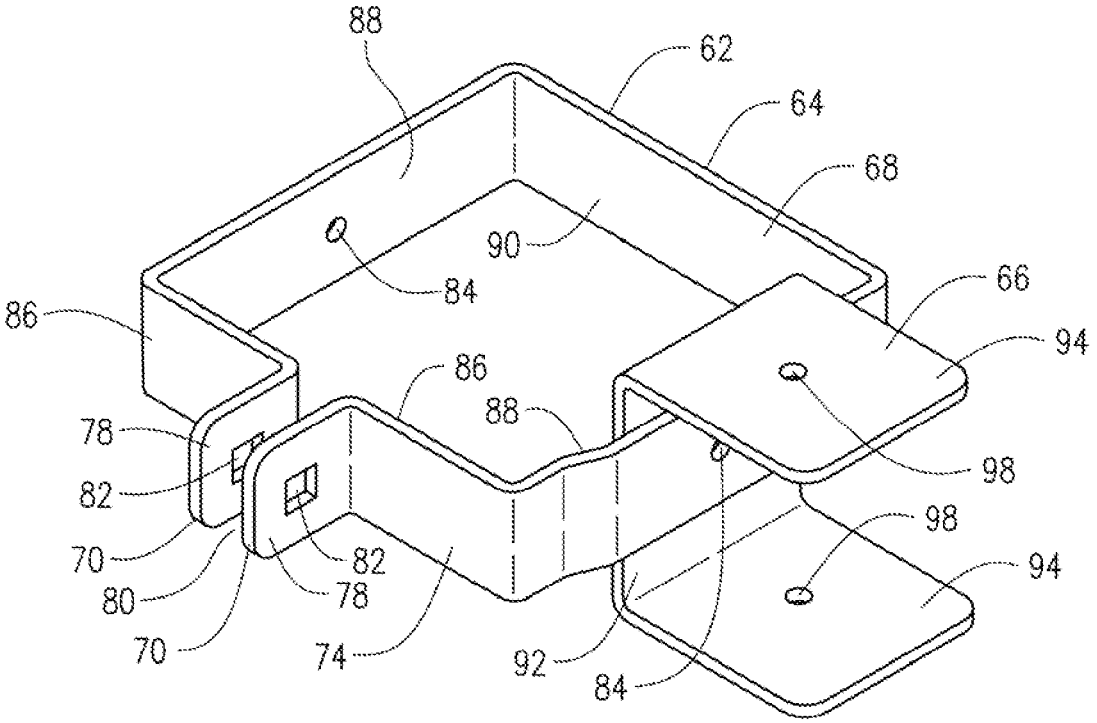
FIG. 4 is a perspective view of a post bracket of a type used on sloped terrain.
Figure 5:
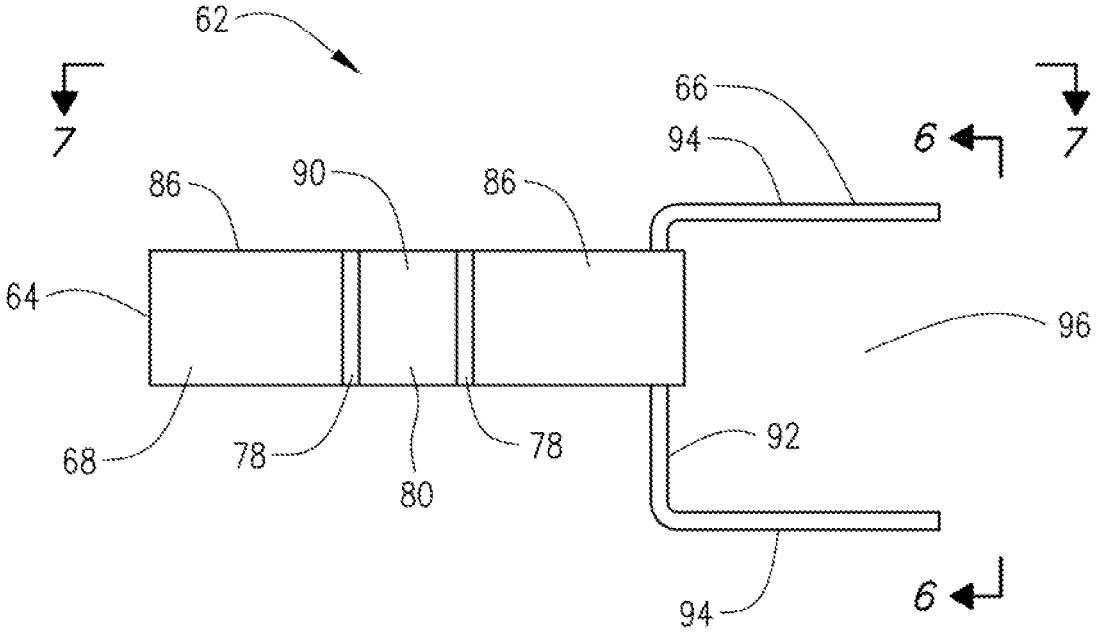
FIG. 5 is a front elevation view of the post bracket shown in FIG. 4.

In the embodiment shown in FIGS. 2 and 3, the post 22 has a rectangular cross-sectional shape. The band 30 and its interior region 38 are accordingly substantially rectangular in shape as well. The band 30 includes four sections corresponding to the four sides of a rectangle. These sections include a front section 46, two side sections 48, and a rear section 50. Each section extends in orthogonal relationship to its adjacent sections. The side sections 48 are opposed to one another, and join the front section 46 to an opposed rear section 50. Preferably, the side sections 48 and rear section 50 are ungapped.

The end tabs 40 extend from a plane that contains the front section 46, in orthogonal relationship to that section. In the embodiment shown in FIGS. 2 and 3, the gap 42 adjoins a corner of the band 30, and the front section 46 is formed as a single piece. In such an embodiment, one end tab 40 is supported by the front section 46, and the other end tab 40 is supported by its adjacent side section 48.

In another embodiment, not shown in the Figures, the gap is situated at or near the longitudinal midpoint of the front section, and divides it into two pieces. Each end tab is supported by a different piece of the front section.

A pair of spaced and opposed channel members 52 extend from opposite edges of the same section of the band 30. In the embodiment shown in FIGS. 2 and 3, the channel members 52 extend from one of the side sections 48. The channel members 52 cooperate with the band 30 to form a channel 54 that extends outside the interior region 38.

The channel members 52 are preferably flat and of the same thickness as the band 30. The channel members 52 are preferably parallel, and extend in orthogonal relationship to the band 30. A fastener opening 56 is formed in each channel member 52, preferably away from any of its edges.

The post bracket 28 is preferably formed from a single piece of material. During formation of the post bracket 28, that piece is initially flat, and thereafter is bent or folded into the required shape. Preferably, the sections 48 and 50 and the end tabs 40 each comprise a single contiguous region within the band 30. The front section 46 may be formed as a single contiguous region as well, as shown in FIGS. 2 and 3.

Alternately, if the gap is offset from a corner, the front section is formed from two separated regions within the band 30.

In the embodiment shown in FIGS. 2 and 3, each section is separated from its adjacent section, or part thereof, by a fold. Each channel member 52 is separated from the adjacent band 30 by a fold. One end tab 40 is separated from the adjacent front section 46, or part thereof, by a fold. The junction between the other end tab 40 and the side section 48 is unfolded.

The post bracket 28 is installed by positioning it above a post 22 that has been installed within a footing 24 within the terrain 12. The post bracket 28 is lowered over the post 22, such that the post 22 passes through the interior region 38. The post bracket 28 is lowered to a level that matches the level of the rail 26 that the post bracket 28 will hold. When a post 22 will hold multiple post brackets 28, the lowermost post bracket 28 is installed first, followed in succession by each next lowermost post bracket 28.

Once a post bracket 28 has been positioned at the required level, the fastener openings 44 in the band 30 are aligned. A fastener 58, such as a nut and bolt assembly, is installed in the aligned openings, as shown in FIG. 3.

A rail 26 is installed within the post bracket 28 by passing it through the channel 54. The rearmost wall of the rail 26 is positioned flush against the band 30. One or more fasteners 60 are inserted through the fastener openings 56 and actuated to secure the post bracket 28 to the rail 26. A single long fastener may be installed through the aligned openings 56, or a shorter fastener installed within each single opening 56. In either instance, the fastener penetrates the rail 26. Once installed, the rail 26 extends through the channel 54 and is secured within it.

The foregoing installation steps are repeated for each post bracket 28, and each associated post 22 and rail 26, within the barrier 10.

Where the terrain 12 is sloped, post brackets 62 are used to support the rails 26, rather than the post brackets 28. The post brackets 62 included in the barrier 10 are preferably identical in size, shape and construction. One such post bracket 62 is shown in FIGS. 2-8. The post bracket 62 is similar to the post bracket 28, but is formed from two pieces, a collar 64 and a holder 66, rather than from a single piece.

The collar 64 is configured to fittingly surround the post 22 upon which it will be installed. The collar 64 is preferably formed from a narrow and elongate band 68 having an opposed pair of ends 70. The band 68 has an internal surface 72 and an opposed external surface 74. The internal surface 72 bounds an interior region 76 of the collar 64 within which a post 22 is receivable.

A flat end tab 78 is formed at each end 70 of the collar 64. The end tabs 78 project outside the interior region 76, are separated by a gap 80, and are preferably disposed in parallel and face-to-face relationship. A fastener opening 82 is formed in each end tab 78, preferably away from any of its edges. One or more pivot openings 84 are also formed in that portion of the band 68 that bounds the interior region 76. Preferably, each pivot opening 84 is circular in shape.

In the embodiment shown in FIGS. 2-8, the post 22 has a square cross-sectional shape. The collar 64 and its interior region 76 are accordingly substantially square in shape as well. The collar 64 includes four sections of equal length corresponding to the four sides of a square. These sections include a front section 86, two side sections 88, and a rear section 90. Each section extends in orthogonal relationship to its adjacent sections. The side sections 88 are opposed to one another, and join the front section 86 to an opposed rear section 90. Preferably, the side sections 88 and rear section 90 are ungapped.

The end tabs 78 extend from a plane that contains the front section 86, in orthogonal relationship to that section. In the embodiment shown in FIGS. 2-8, the gap 26 is situated at or near the longitudinal midpoint of the front section 86, and divides it into two pieces. Each end tab 78 is supported by a different piece of the front section 86.

In another embodiment, not shown in the Figures, the gap adjoins a corner of the collar, and the front section is formed as a single piece. In such an embodiment, one end tab is supported by the front section and the other end tab is supported by its adjacent side section.

The collar 64 is preferably formed from a single piece of material, which will become the band 68. During formation of the collar 64, that piece is initially flat, and thereafter is bent or folded into the required shape. Preferably, the sections 88 and 90 and the end tabs 78 each comprise a contiguous region within the band 68. The gapped front section 86 is formed from two separated regions within the band 68.

In the embodiment shown in FIGS. 2-8, each section is separated from the adjacent section, or part thereof, by a fold. Each end tab 78 is separated from its adjacent partial front section 86 by a fold as well.

Each post bracket 62 further comprises a channel-shaped holder 66 that is supported by the collar 64. The holder 66 is rotatable with respect to the collar 64 and is configured to closely receive a rail 26 therein.

Preferably, the holder 66 comprises a base 92 that joins a pair of spaced and opposed side walls 94. The base 92 and side walls 94 cooperate to form a channel 96. The base 92 and side walls 94 are preferably flat and of the same thickness and width. The side walls 94 are preferably parallel, and extend in orthogonal relationship to the base 92. The base 92 is penetrated by a centrally-disposed pivot opening (not shown), which is preferably circular in shape. A fastener opening 98 is formed in each side wall 94, preferably away from any of its edges.

The holder 66 is preferably formed from a single piece of material that is bent or folded into a channel shape. Preferably, the base 92 and side walls 94 each comprise a contiguous region within the same single piece of material. Each side wall 94 is separated from the base 92 by a fold.

The collar 64 and holder 66 are assembled by passing one of the side sections 88 through the channel 96 of the holder 66. The internal surface 72 of the side section 88 is placed flush against the base 92. The pivot opening 84 and the pivot opening in the base 92 are aligned, and a solid pivot element 100 is received through the aligned openings. In one embodiment, the pivot element 100 may comprise a self-drilling screw, such as a Tek screw.

Figure 6:
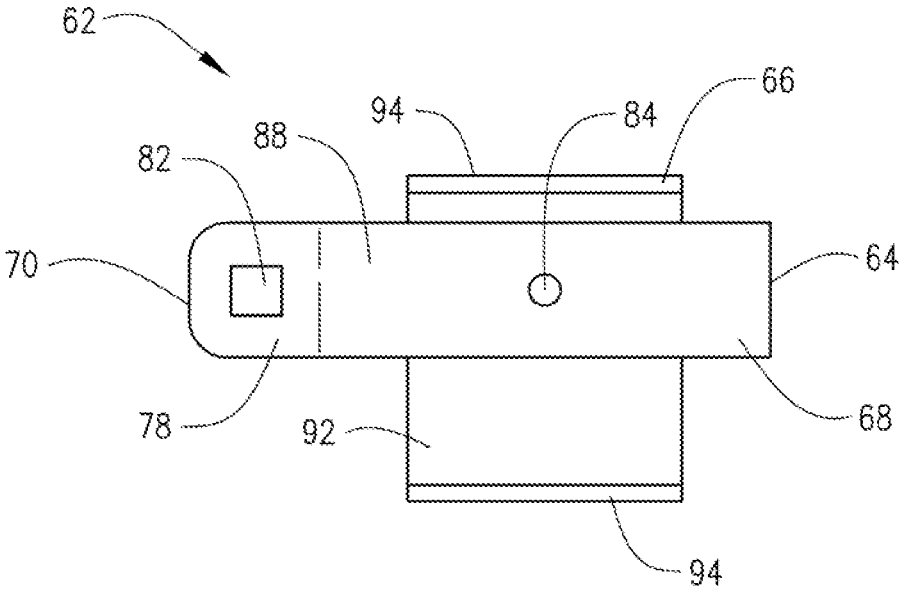
FIG. 6 is a side elevation view of the post bracket shown in FIG. 5, taken along line 6-6. The pivot element is not shown.
Figure 7:
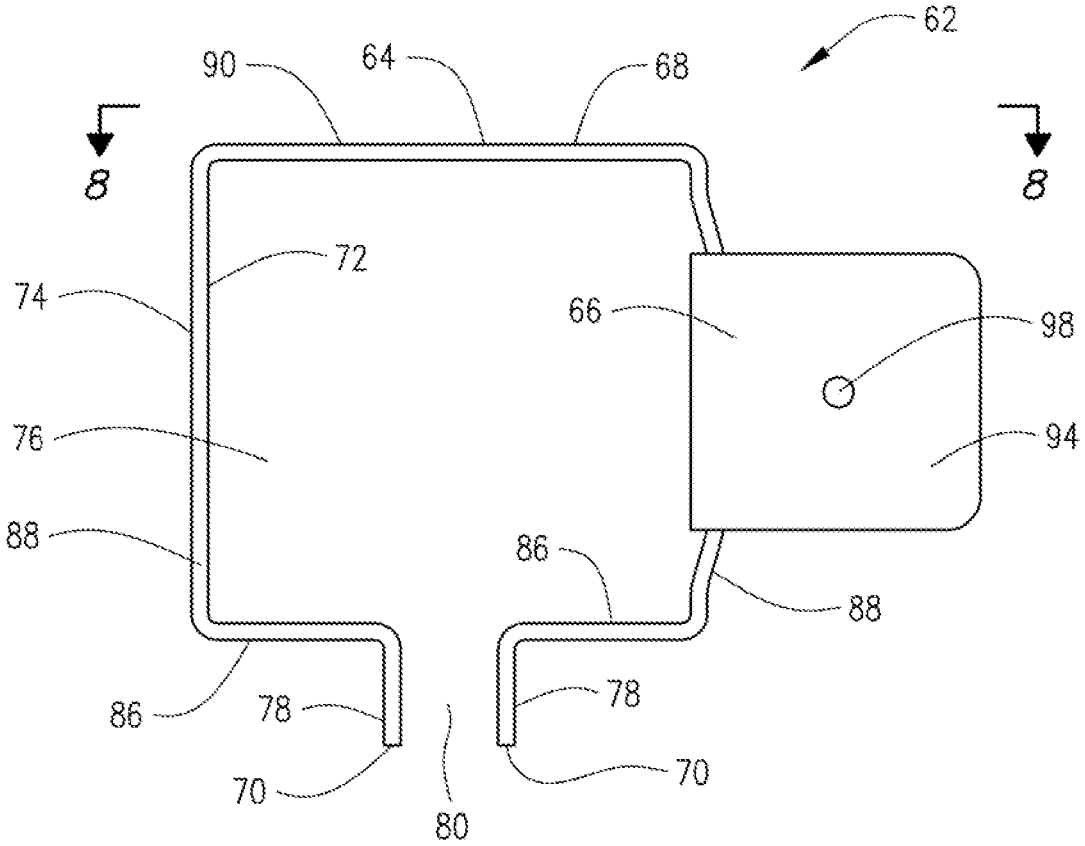
FIG. 7 is a top plan view of the post bracket shown in FIG. 5, taken along line 7-7.
Figure 5:
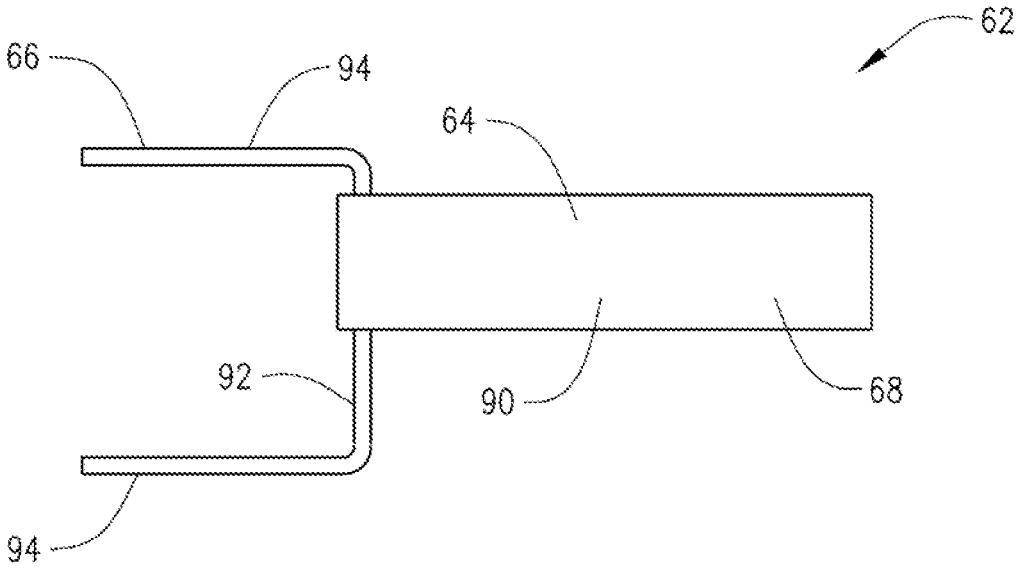
Figure 6:
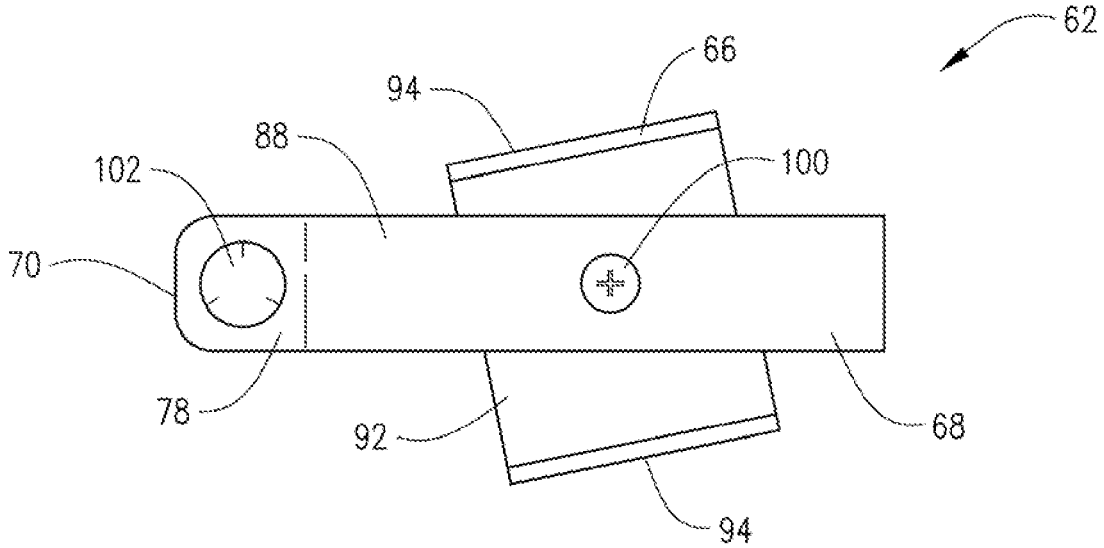

After assembly, the base 92 of the holder 66 extends within the interior region 76 of the collar 64. The pivot element 100 joins the collar 64 and holder 66, while permitting relative rotation between them. FIG. 6 shows a post bracket 62 with the holder 66 in an untilted position relative to the collar 64. FIG. 9 shows the same post bracket 62 after relative rotation has placed the holder 66 in a tilted position.

After its assembly, a post bracket 62 is positioned above a post 22 that has been installed within a footing 24 within the terrain 12. The post bracket 62 is lowered over the post 22, such that the post 22 passes through the interior region 76. The post bracket 62 is lowered to a level that matches the level of the rail 26 that the post bracket 62 will hold. When a post 22 will hold multiple post brackets 62, the lowermost post bracket 62 is installed first, followed in succession by each next lowermost post bracket 62.

Figure 10:
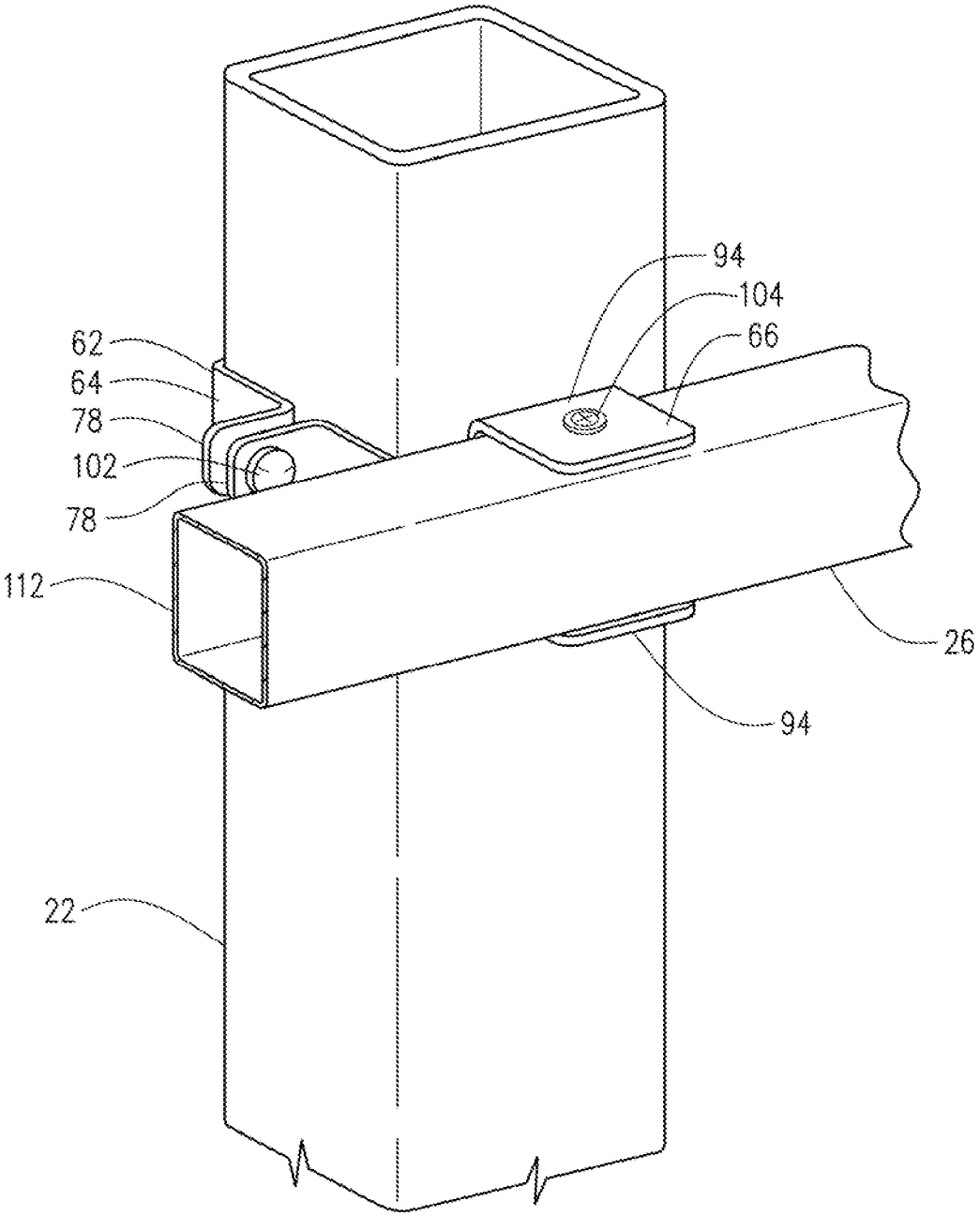
FIG. 10 is a perspective view of the post bracket shown in FIG. 4, in an assembled configuration within a portion of a barrier.

Once a post bracket 62 has been positioned at the required level, the fastener openings 82 in the band 68 are aligned. A fastener 102, such as a nut and bolt assembly, is installed in the aligned openings, as shown in FIG. 10.

If the terrain 12 is flat, no tilting of the holder 66 is required. This configuration is shown in FIG. 10. However, the post bracket 62 will normally be used where the terrain 12 is sloped. In that event, the holder 66 should be tilted by an angle that matches the slope of the terrain. Specifically, the holder 66 and band 68 should be relatively rotated until the included angle between the uppermost side wall 94 and the band 68 matches the grade angle of the terrain 12. Once any needed tilting has been performed, the holder 66 is ready to receive a rail 26.

A rail 26 is installed within the holder 66 by passing it through the channel 96. The rearmost wall of the rail 26 is positioned flush against the base 92. One or more fasteners 104 are inserted through the fastener openings 98 and actuated to secure the holder 66 to the rail 26. A single long fastener may be installed through the aligned openings 98, or a shorter fastener installed within each single opening 98. In either instance, the fastener penetrates the rail 26. Once installed, the rail 26 extends through the holder 66, and is secured within it.

The foregoing installation steps are repeated for each post bracket 62, and each associated post 22 and rail 26, within the barrier 10.

Figure 11:
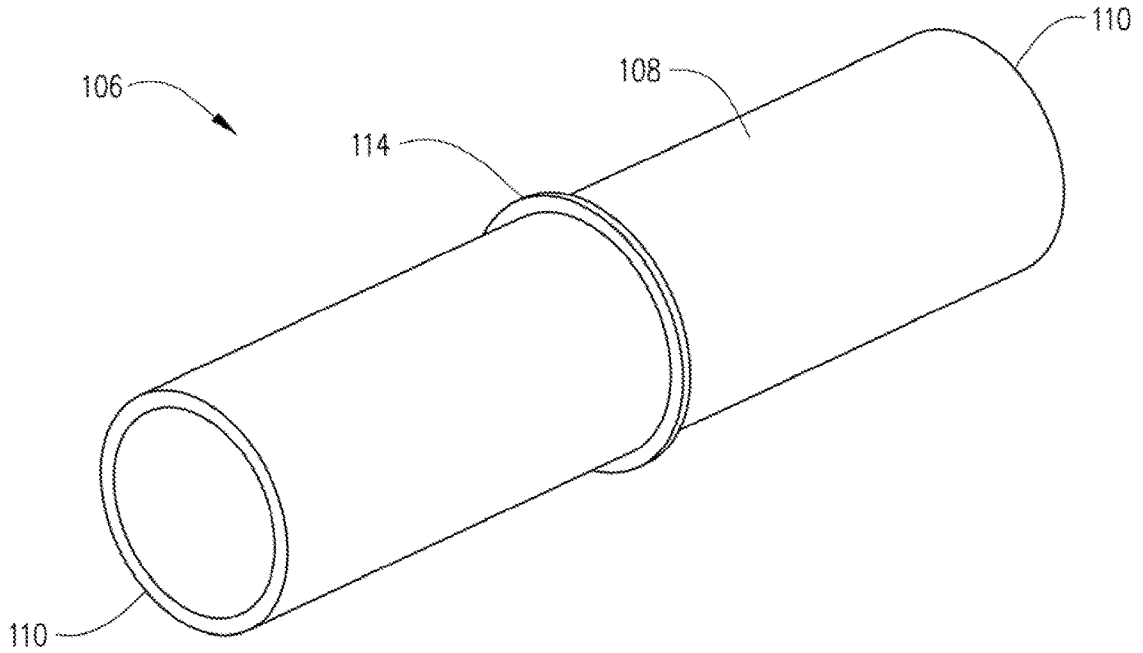
FIG. 11 is a perspective view of a connector.
Figure 12:
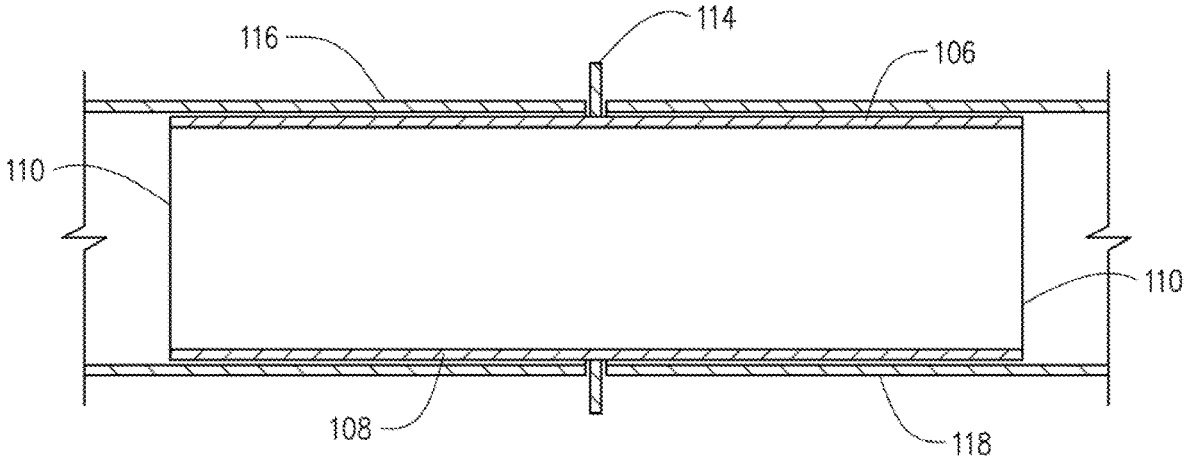
FIG. 12 is a cross-sectional view of a portion of a barrier, showing two rails in end-to-end engagement. The connector shown in FIG. 11 joins the rails.
Figure 14:
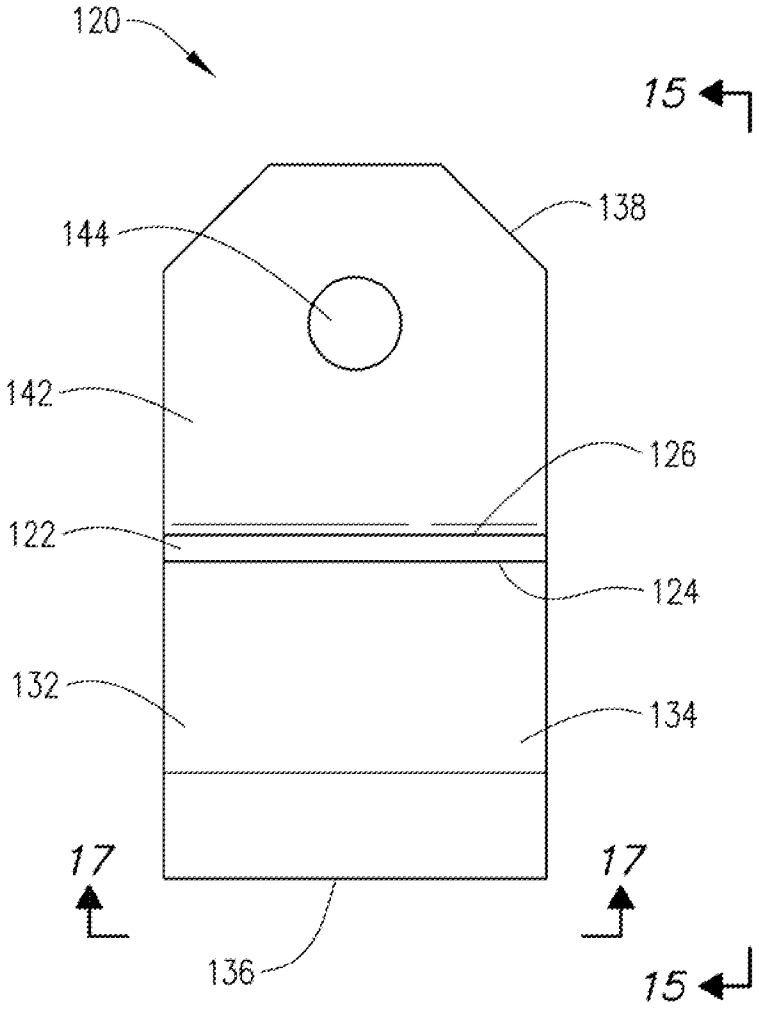
FIG. 14 is a front elevation view of the adapter shown in FIG. 13.
Figure 15:
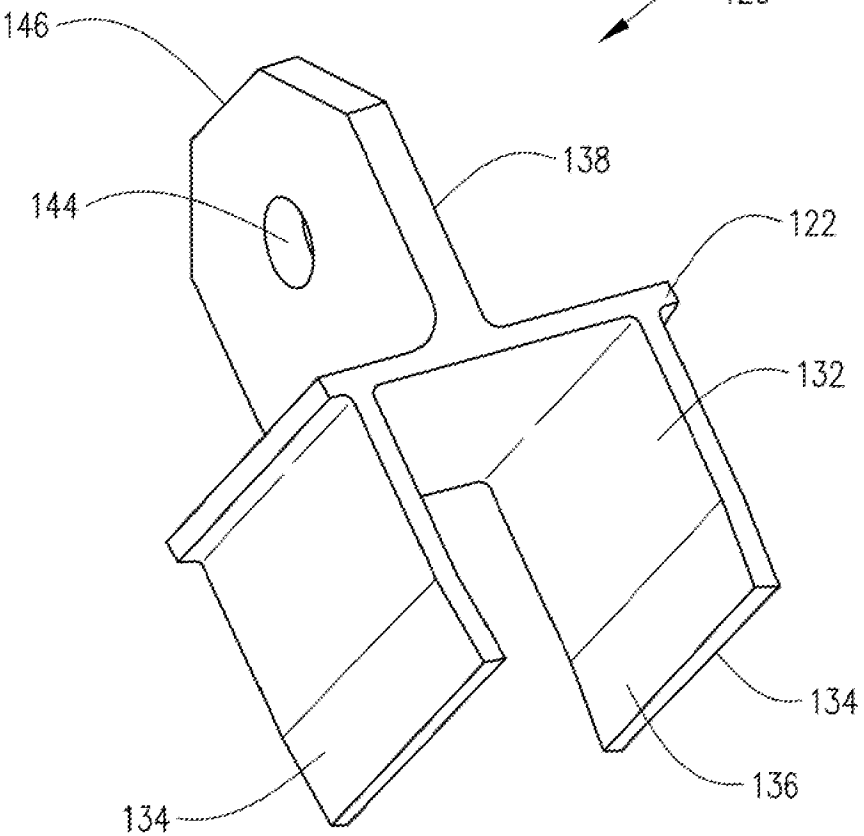
FIG. 15 is a side elevation view of the adapter shown in FIG. 14, taken along line 15-15.
Figure 15:
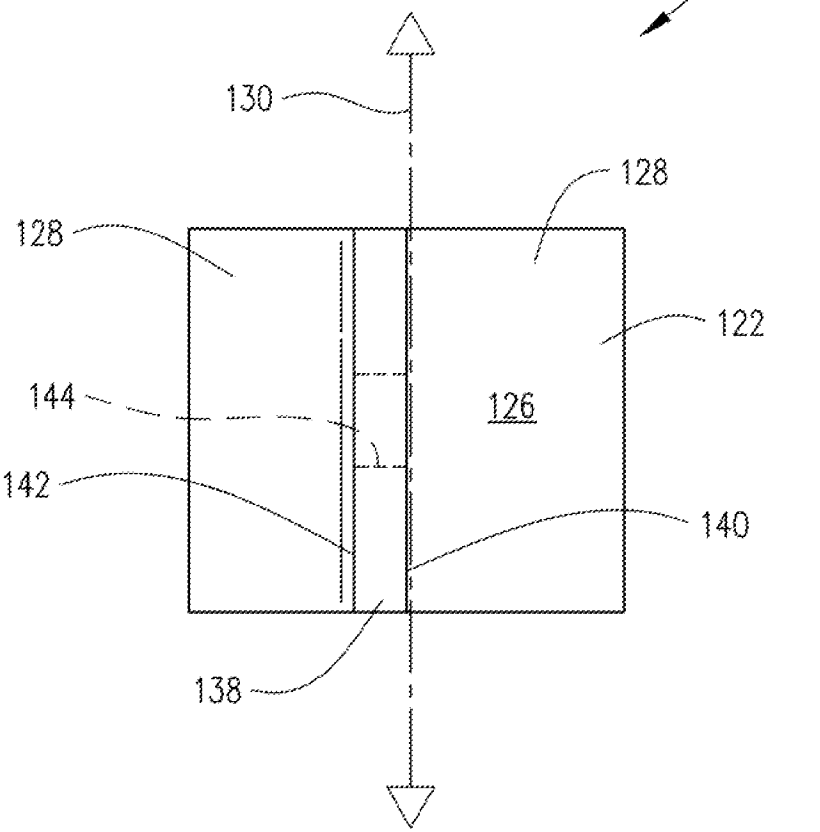

As shown in FIG. 1, the framework 16 forming the barrier 10 may comprise one or more rails 26 that have been joined in end-to-end engagement. When the terrain 12 is flat, connectors 106 are used to join these rails 26. The connectors 106 included in the barrier 10 are preferably identical in size, shape and construction. One such connector 106 is shown in FIGS. 11 and 12.

Each connector 106 is formed from an elongate body 108 having a rectilinear longitudinal axis, a uniform cross-sectional shape and a pair of opposed ends 110. Preferably, the body 108 is tubular. More preferably, the body 108 comprises a hollow and open-ended cylinder. Adjacent each of its ends 110, the body 108 is sized to be closely but clearingly received within the hollow end 112 of a rail 26. In one embodiment, the body 108 is about 8 inches in length and has a diameter of 1.875 inches.

Adjacent its longitudinal midpoint, the body 108 is provided with a plate 114, which is preferably situated in coaxial relationship to the body 108. The plate 114 should have a maximum cross-sectional dimension that exceeds the maximum cross-sectional dimension of the rail 26.

A central opening in the plate 114 can closely but clearingly receive the body 108 therethrough. When the body 108 is cylindrical, the central opening is circular, and the plate 114 is annular. After installation, the plate 114 is permanently fixed at the midpoint of the body 108, such as by welding. By blocking a rail 26 from receiving more than half of the body 108, the plate 114 protects a connector 106 from being "swallowed" within a rail 26.

FIG. 12 shows the interconnection between a first rail 116 and a second rail 118. An end 110 of a connector 106 is inserted into the hollow end 112 of each rail. The ends 112 of the rails abut or adjoin opposite sides of the plate 114. Once the rails and connector 106 are positioned, a fastener (not shown) is driven into each rail and into the underlying portion of the connector 106. The fastener may comprise a self-drilling screw, such as a Tek screw.

The foregoing installation steps are repeated for each connector 106, and its associated rails 26, within the barrier 10.

Where the terrain 12 is sloped, adapters are used to interconnect the rails 26, rather than the connectors 106. The adapters included in the barrier 10 are preferably identical in size, shape and construction. One such adapter 120 is shown in FIGS. 9-13.

Figure 16:
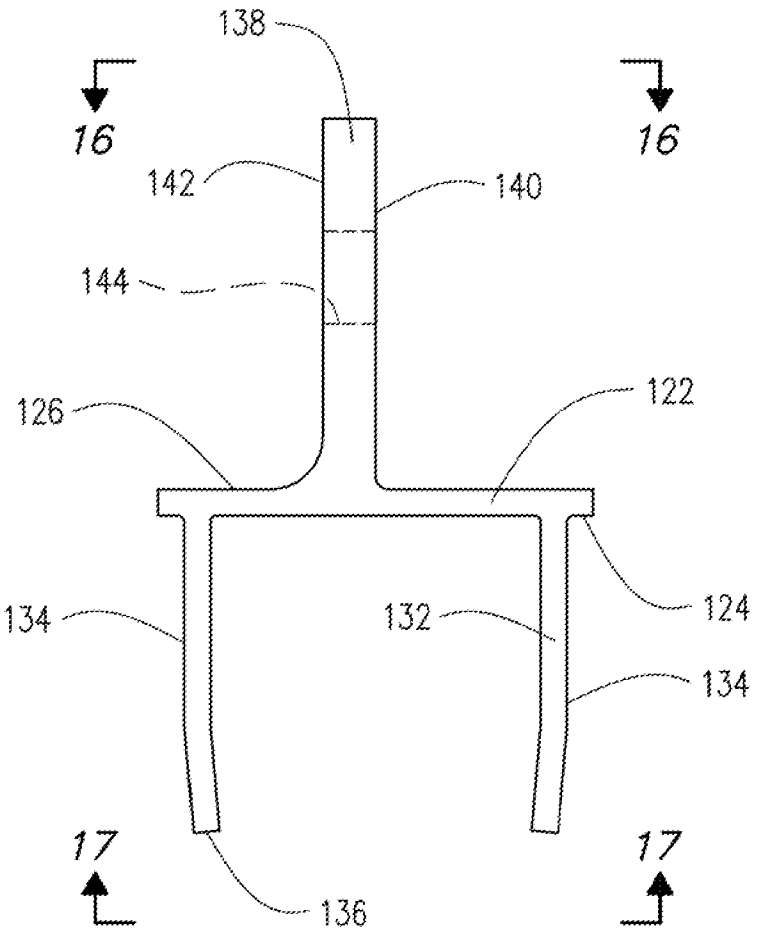
FIG. 16 is a top plan view of the adapter shown in FIG. 15, taken along line 16-16.

Each adapter 120 comprises a base 122 having a first side 124 and an opposed and parallel second side 126. Preferably the base 122 is flat, and characterized by a uniform cross-sectional profile. That profile is preferably rectangular, and more preferably square. The base 122 is bisected into two identically sized sections 128 by a centerline 130, as shown in FIG. 16.

Each adapter 120 further comprises a plug element 132 that extends from the first side 124 of the base 122. The plug element 132 is shaped and sized to be closely but clearingly receivable within the hollow end 112 of a rail 26. Preferably, the plug element 132 is symmetric about a plane that extends in orthogonal relationship to the base 122.

The plug element 132 comprises a pair of spaced, parallel and opposed walls 134. The walls 134 may be bowed slightly inward at the lower extremity 136 of the plug element 132, in order to facilitate its insertion into a rail 26.

Each adapter 120 further comprises a flat lug 138 that extends from the second side 126 of the base 122. The lug 138 has a first side 140 and a parallel and opposed second side 142, and preferably extends in orthogonal relationship to the base 122. As shown in FIG. 16, the lug 138 joins the base 122 entirely within a single section 128. The first side 140 of the lug 138 is coplanar with the centerline 130 that divides the base 122.

In the embodiment shown in FIGS. 9-13, the lug 138 has the cross-sectional shape of a rectangle surmounted by a regular trapezoid. The lug 138 is penetrated by a pivot opening 144 formed adjacent its upper extremity 146. Preferably the pivot opening 144 is circular in shape, with a center situated along a line that longitudinally bisects the lug 138 into sections of equal size.

The adapter 120 is preferably formed from a strong and durable material, and more preferably from a material that is relatively lightweight and extrudable as well. In one embodiment, the adapter 120 is formed from aluminum, either in elemental or alloyed form. Preferably, the adapter 120 is formed as a single piece, and by extrusion.

Figure 18:
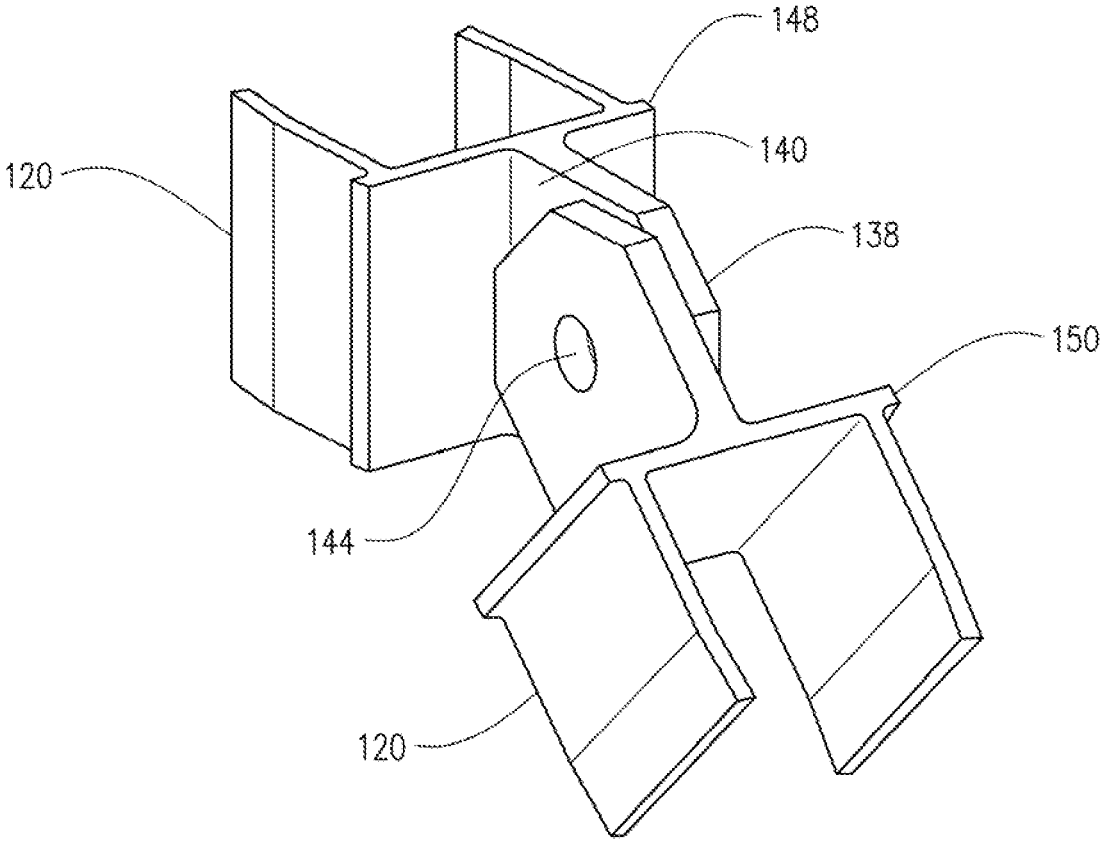
FIG. 18 is a perspective view of two of the adapters shown in FIG. 13, in an engaged configuration.

Two interconnecting adapters 120 are shown in FIG. 18. First and second adapters 148 and 150 are positioned such that their lugs 138 are disposed in side-to-side engagement at their respective first sides 140. The respective pivot openings 144 of the adapters are aligned. In this configuration, a solid pivot element (not shown) may be received through the aligned pivot openings 144. The pivot element joins the adapters 120, while permitting their relative rotation.

Figure 19:
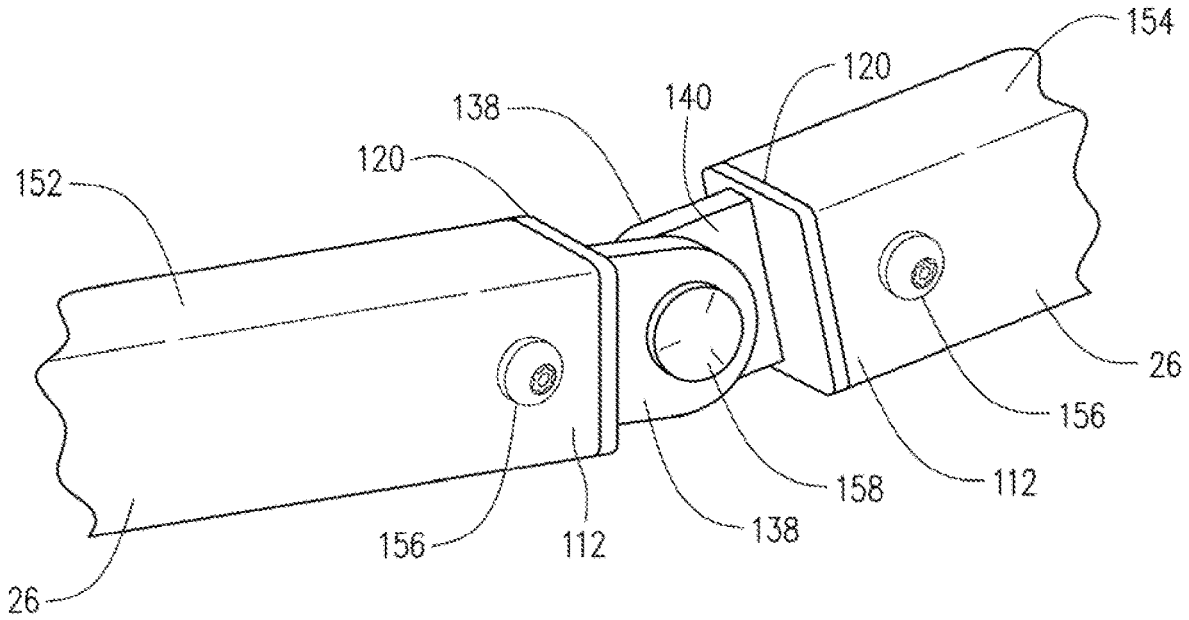
FIG. 19 is a perspective view of a portion of a barrier, showing two rails in end-to-end engagement. Each rail is fitted with the adapter shown in FIG. 13. The pivot element is not shown.

FIG. 19 shows the interconnection between a first rail 152 and a second rail 154. An adapter 120 is inserted into the hollow end 112 of each rail. Because the rails 26 and the base 122 of the adapter 120 have a square cross-sectional shape, several orientations of each adapter 120 are possible. In general, the adapters 120 should be oriented such that their lugs 138 are either both vertical, or both horizontal. Either orientation is acceptable when the terrain 12 is flat at and around the interconnection site. In such a flat environment, the lugs 138 of the adapters 120 should be positioned in side-to-side engagement at their respective first sides 140, with the pivot openings 144 aligned.

One or more fasteners 156 are installed on each rail 26, in order to secure the rail 26 to associated adapter 120. The one or more fasteners 156 may comprise self-drilling screws, such as Tek screws. Each fastener 156 preferably passes through the rail 26 and through at least one wall 134 of the adapter 120. A solid pivot element 158 is received through the aligned pivot openings 144, thereby joining the adapters 120, and thus the rails 152 and 154, in end-to-end engagement.

FIG. 1 shows the barrier 10 installed on a terrain 12 that is partially sloped. In such an environment, the respective lengths of the connected rails 26 are preferably chosen such that their interconnection site 160 is at or near a point of grade transition 162. In such a non-flat environment, the respective lugs 138 of the adapters 120 should be oriented vertically. Once connected, one rail may be rotated relative to the other about a horizontal axis that extends through the aligned pivot openings 144. Such relative rotation permits the barrier 10 to conform to changes in the grade of the terrain 12.

The foregoing installation steps are repeated for each pair of adapters 120, and their associated rails 26, within the barrier 10.

Figure 20:
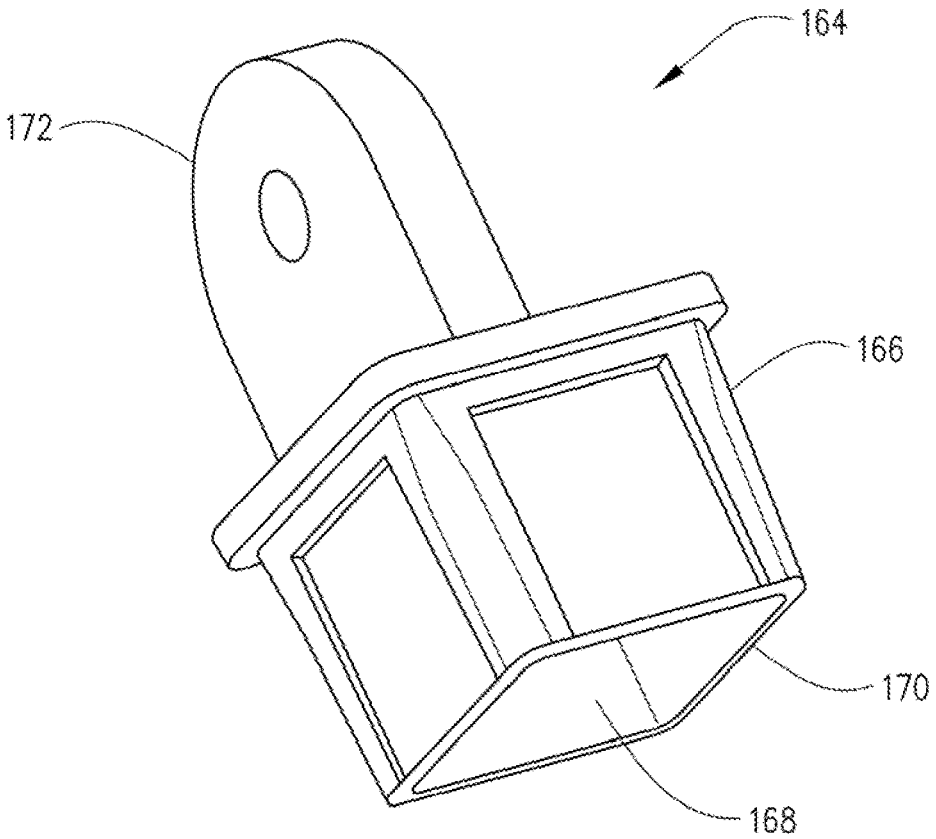
FIG. 20 is a perspective view of another embodiment of an adapter.
Figure 21:
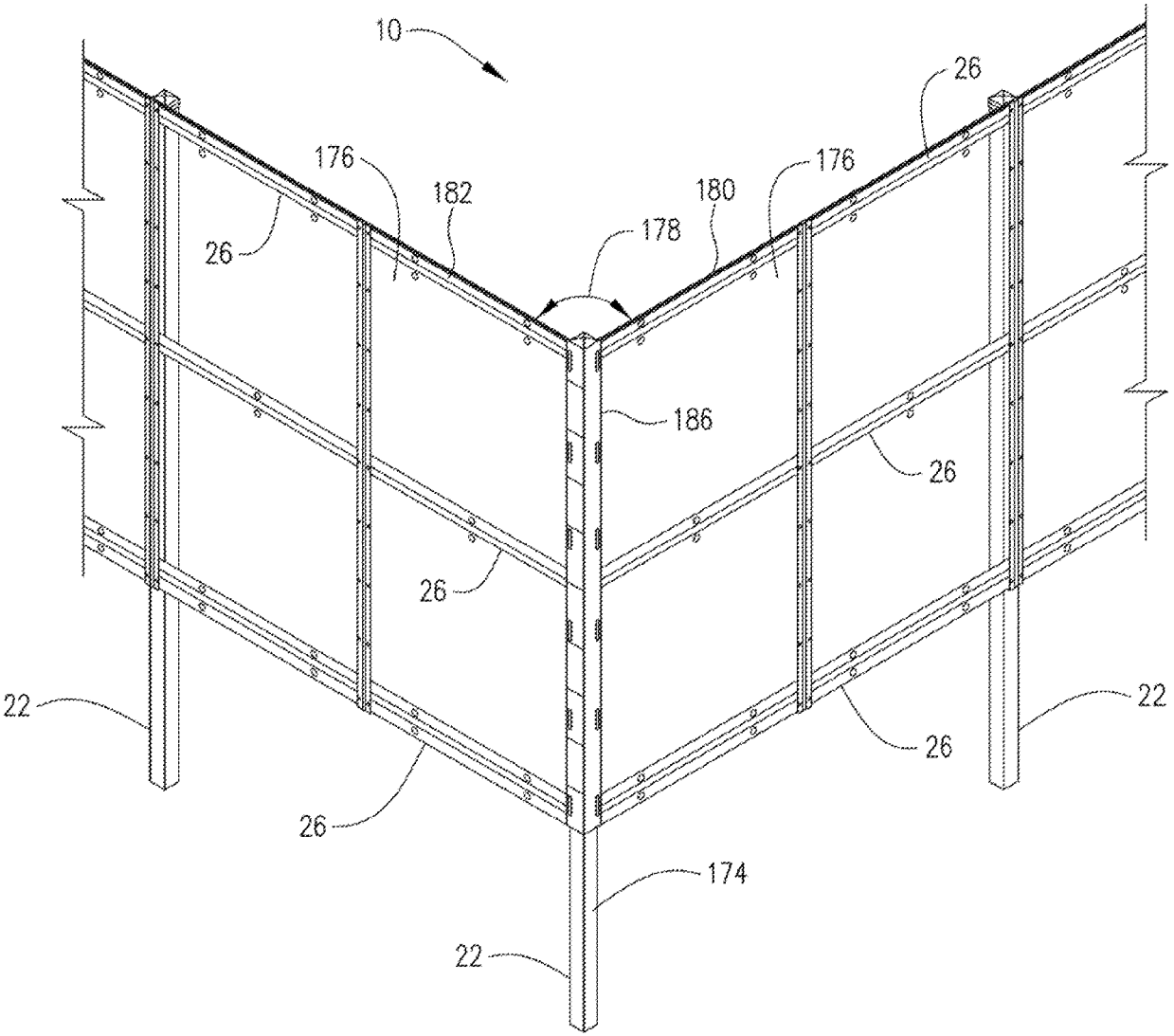
FIG. 21 is a perspective view of a corner section of a barrier. The terrain and footings are not shown.
Figure 22:
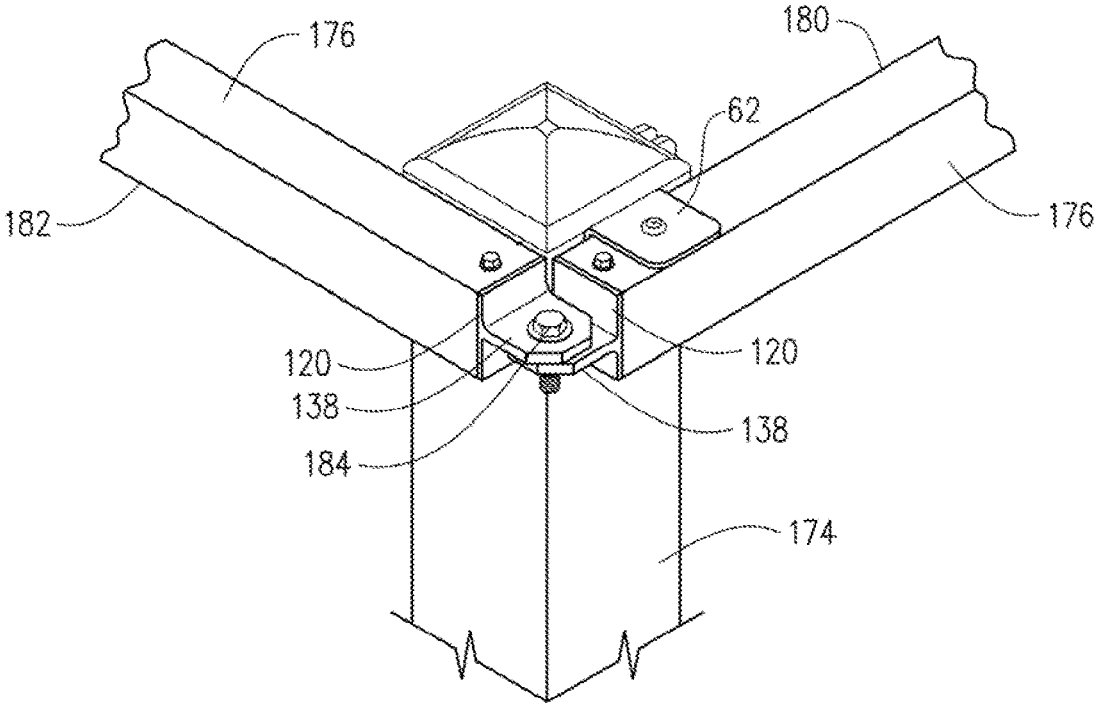
FIG. 22 is an enlarged perspective view of a portion of the corner section shown in FIG. 21. The cladding element is not shown.
Figure 23:
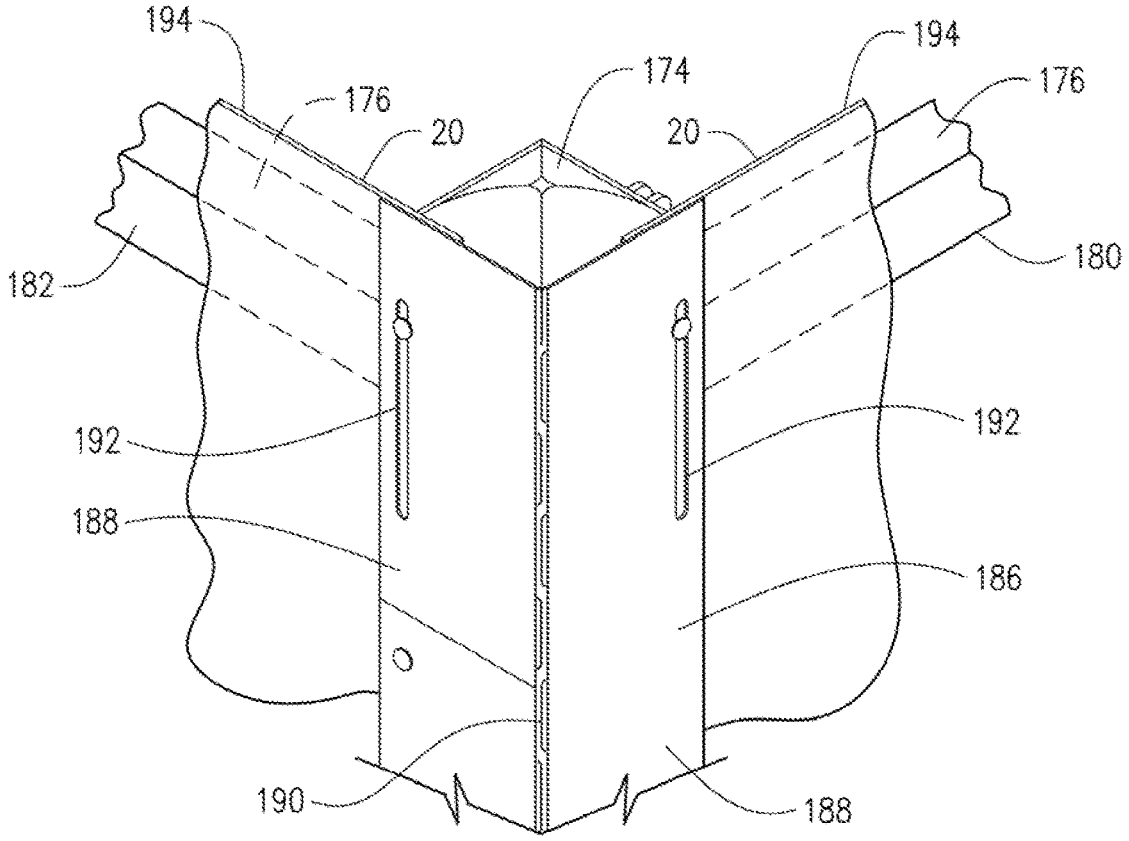
FIG. 23 is an enlarged perspective view of a portion of the corner section shown in FIG. 21. The cladding element is shown.
Figure 25:
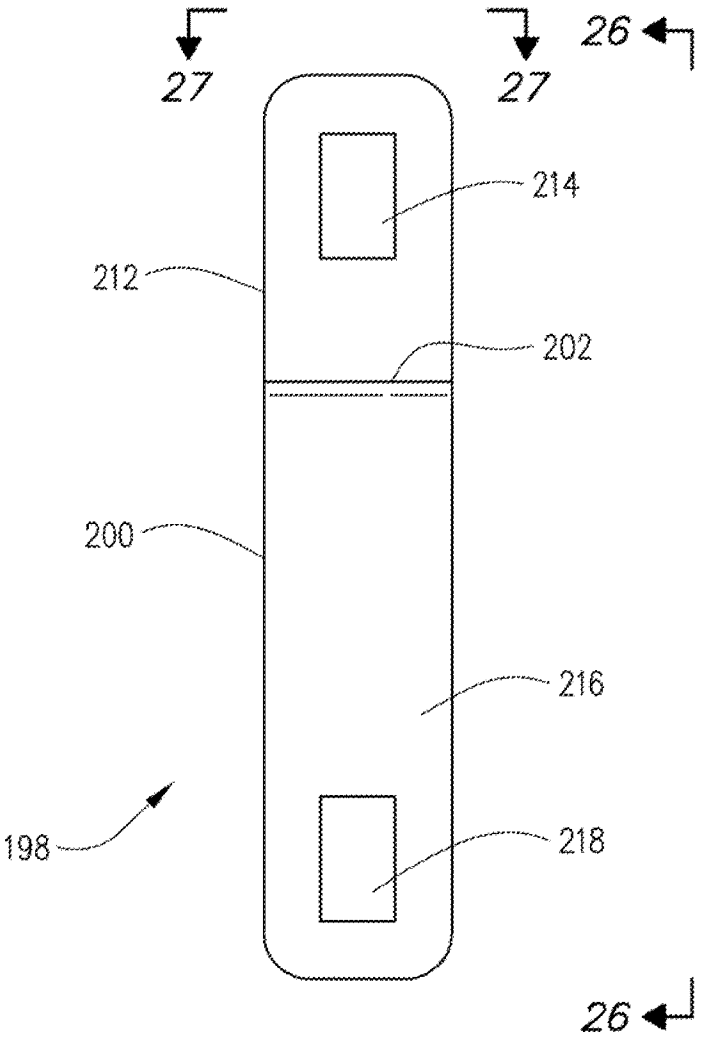
FIG. 25 is a front elevation view of the rail bracket shown in FIG. 24.
Figure 24:
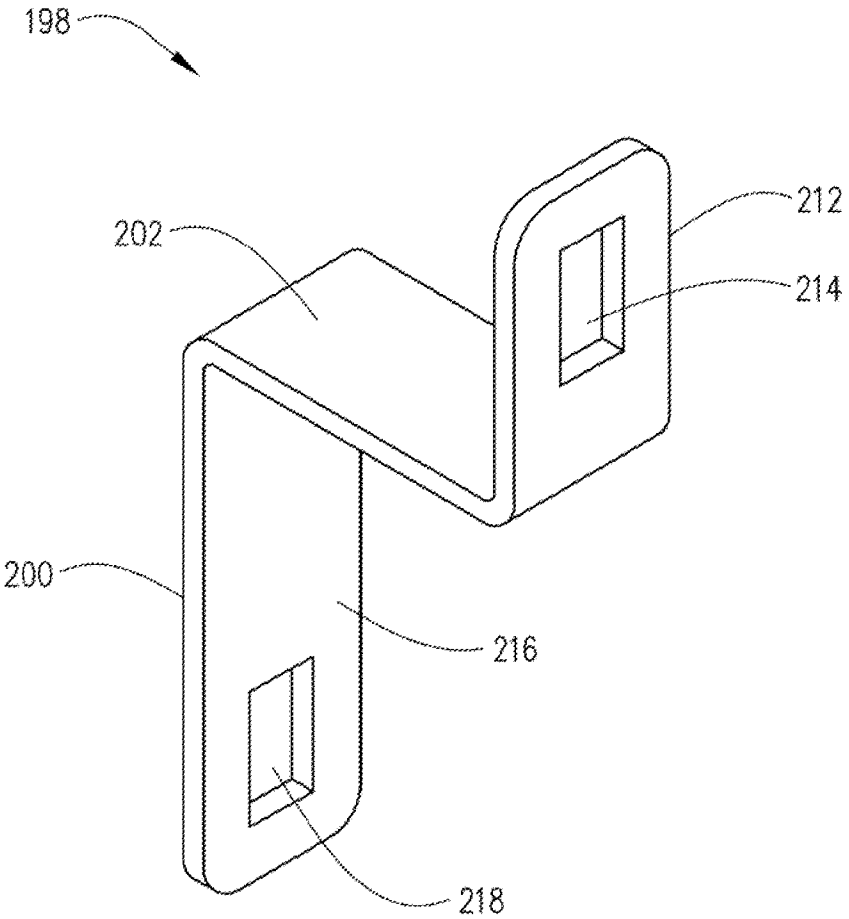
FIG. 24 is a perspective view of a rail bracket.
Figure 27:
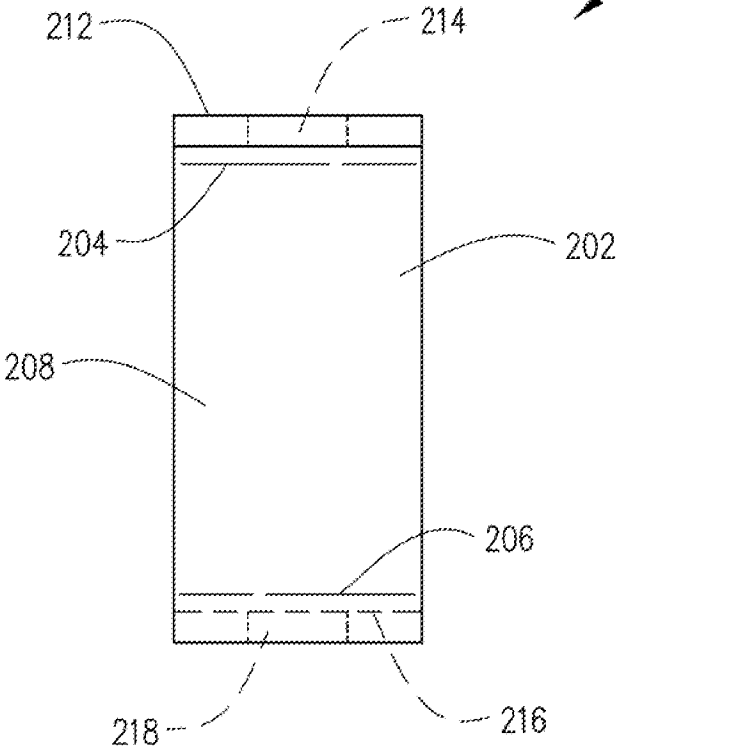
FIG. 27 is a top plan view of the rail bracket shown in FIG. 25, taken along line 27-27.

FIG. 20 shows an adapter 164 that may be used in place of the adapter 120 in the barrier 10. In the adapter 164, the plug element 132 has been replaced with a plug element 166. In contrast to the spaced walls 134 of the plug element 132, the plug element 166 consists of a hollow box-like structure having a rectangular cross-sectional profile and an open end 168 at its lower extremity 170. The size, shape and separation distance of any pair of opposed walls in the plug element 166 is substantially the same as that for the walls 134 in the plug element 132.

The adapter 164 includes a lug 172 having the shape of a rectangle surmounted by a semicircle. This shape contrasts with that of the lug 138, which has the shape of a rectangle surmounted by a regular trapezoid. Other features of the adapter 164 and its manner of installation are identical to those described with reference to the adapter 120.

The adapter 164 is preferably formed from a strong and durable material, and more preferably from a material that is relatively lightweight and extrudable as well. In one embodiment, the adapter 164 is formed from aluminum, either in elemental or alloyed form. Preferably, the adapter 164 is formed as a single piece, and by casting.

Figure 17:
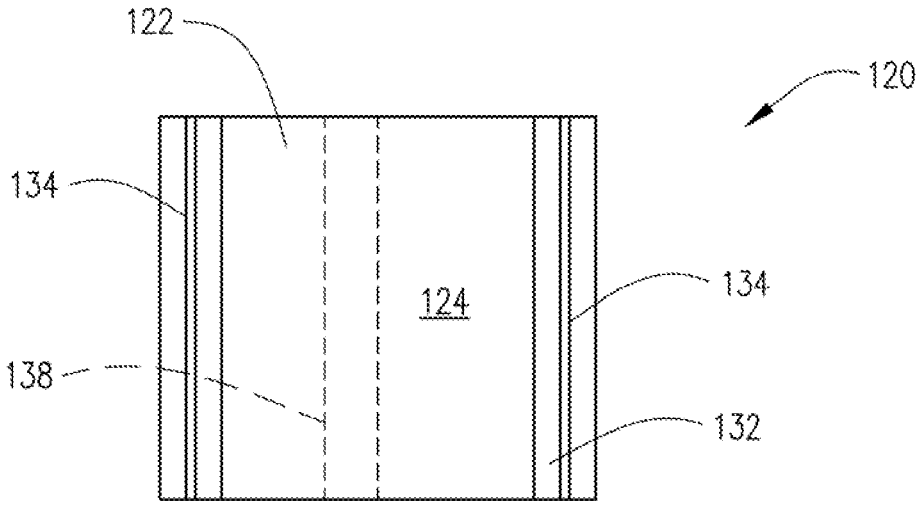
FIG. 17 is a bottom plan view of the adapter shown in FIG. 14, taken along line 17-17.

FIGS. 17-19 show how the barrier 10 is formed at a corner post 174, where adjacent sections 176 join at a non-straight junction angle 178. The junction angle 178 in FIGS. 17-19 is ninety degrees. A post bracket 62 is installed on the corner post 174 and supports a first rail 180. The adapter 120 installed in the end of the first rail 180 is oriented such that its lug 138 extends horizontally, and is situated nearest the lower side of the first rail 180.

The second rail 182 that joins the first rail 180 is not supported by the post bracket 62. The adapter 120 installed in the end of the second rail 182 is oriented such that its lug 138 extends horizontally, and is situated nearest the upper side of the second rail 182. The adapters 120 are in side-to-side engagement at their first sides 140. The lug 138 of the adapter 120 installed within the second rail 182 rests atop the lug 138 of the other adapter 120. A solid pivot element 184, such as a nut and bolt assembly, joins the lugs 138 at their aligned pivot openings. The foregoing installation steps are repeated for each corner post 174, joined rails 26 and their associated adapters 120 and post bracket 62 within the barrier 10.

Because the lugs 138 are oriented horizontally, one rail may be rotated relative to the other about a vertical axis that extends through the aligned pivot openings. This relative rotatability permits a range of junction angles 178 to be formed between adjacent sections 176 at a corner post 174. The rails 180 and 182 may accordingly be assembled into barriers 10 of different shapes.

Once all of the rails 26 that join at the corner post 174 have been assembled, an elongate cladding element 186 may be installed. The cladding element 186 partially covers the corner post 174, and has a length equal to its above-ground height. The cladding element 186 features a pair of thin and flat wings 188 that are joined at a flexible hinge 190. Formed in each wing 188 are a series of vertically spaced slots 192. Fasteners installed in the slots 192 are used to secure each wing to the rails 26 forming the underlying section 176 of the barrier 10.

The infill sections 20 forming the barrier 10 are preferably identical in construction, although these sections may differ in shape and size. Each infill section 20 can be formed from any fencing fabric, and may be characterized by a meshlike structure. Suitable materials for the infill section 20 include wire, expanded metal, and louvered mesh. In a wire infill section 20, 6 or 8 gauge wire may be used.

The typical infill section 20 is characterized by a rectangular shape, although differently shaped infill sections may be used at areas of grade transition. Each rectangular infill section 20 includes a pair of spaced longitudinal edges 194 and a pair of spaced lateral edges 196. The length of each lateral edge 196 preferably equals or exceeds the above-ground height of the posts 22 forming the barrier 10. The length of each longitudinal edge 194 preferably equals or exceeds the separation distance between adjacent posts 22 in the barrier 10. A single infill section 20 may have a longitudinal edge 194 that is two to three times longer than the separation distance between adjacent posts 22.

A single infill section 20 may cover all or part of a single opening 18. In some instances, a single infill section 20 may cover all or part of more than one opening 18. When the barrier 10 is fully assembled, each opening 18 is fully covered by one or more infill sections 20.

FIGS. 20-23 show a rail bracket 198 used to join an infill section 20 to the framework 16 forming the barrier 10. A plurality of these brackets 198 are used in the barrier 10. Preferably these rail brackets 198 are identical in size, shape and construction.

The rail bracket 198 comprises a narrow and elongate band 200 of uniform width. The band 200 has opposed ends, between which a flat seat 202 is formed. The seat 202 is preferably of rectangular shape, and has a first end 204, an opposed second end 206, an upper side 208 and an opposed lower side 210. The seat 202 is stably positionable atop the rail 26 that it will engage. Preferably, the seat 202 has a length that matches the width of a side of a rail 26.

The rail bracket 198 further comprises a flat first arm 212, preferably of rectangular shape and having a width and thickness equalling that of the seat 202. The first arm 212 extends from the first end 204 of the seat 202, and preferably shares a common edge therewith. The first arm 212 extends adjacent the upper side 208 of the seat 202, preferably in orthogonal relationship thereto. The first arm 212 is penetrated by a fastener opening 214.

The rail bracket 198 further comprises a flat second arm 216, preferably of rectangular shape and having a width and thickness equalling that of the seat 202 and the first arm 212. The second arm 216 extends from the second end 206 of the seat 202, and preferably shares a common edge therewith.

The second arm 216 extends adjacent the lower side 210 of the seat 202, preferably in orthogonal relationship thereto. Preferably, the length of the second arm 216 exceeds that of the first arm 212. The second arm 216 is penetrated by a fastener opening 218.

The seat 202 and second arm 216 are sized and shaped to engage two adjacent sides of a rail 26. When the rail bracket 198 is so positioned, the first arm 212 is situated in coplanar relationship to a third and different side of the same rail 26.

The rail bracket 198 is preferably formed from a single piece of material, namely the band 200. During formation of the rail bracket 198, the band 200 is initially flat, and is thereafter bent or folded between its ends into a zigzag shape. Preferably, the seat 202 and arms 212 and 216 each comprise a contiguous region within the band 200. Each arm 212 and 216 is separated from the seat 202 by a fold.

Figure 28:
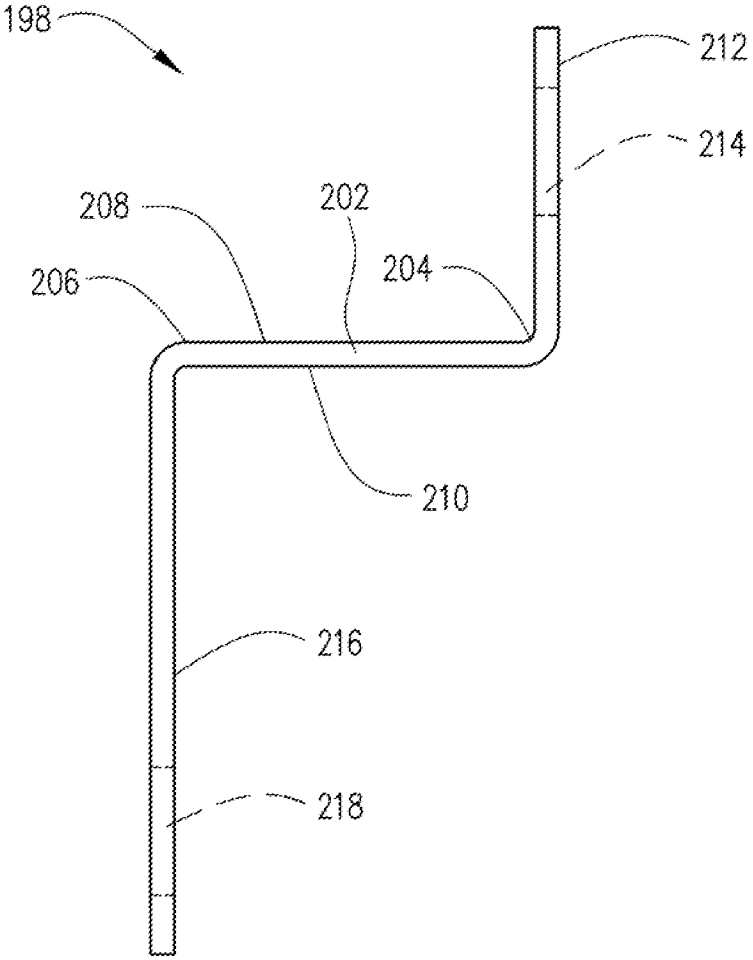
FIG. 28 is a perspective view of the rail bracket shown in FIG. 24, in combination with the fasteners that are used to incorporate it into a barrier.
Figure 28:
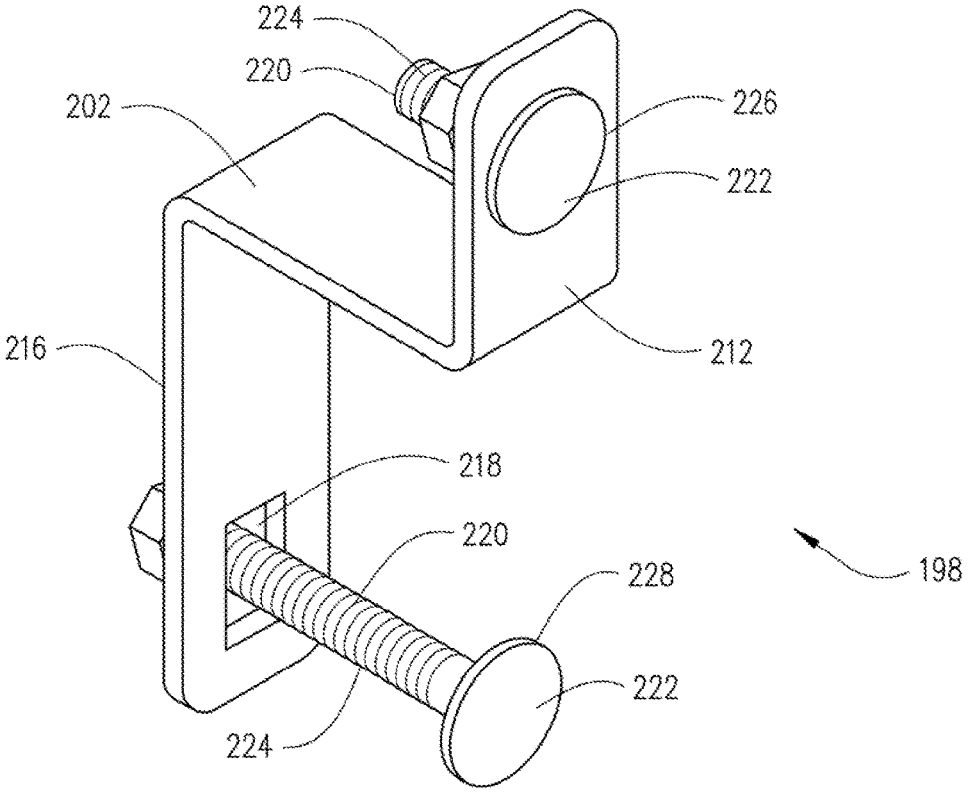

The rail bracket 198 is preferably installed with a pair of fasteners 220, shown in FIG. 28. Each fastener 220 includes an enlarged head 222 from which an elongate shaft 224 extends. The pair of fasteners 220 consists of a first fastener 226 and a second fastener 228. Preferably, the shafts 224 of the first and second fasteners 226 and 228 have differing lengths. Specifically, the shaft 224 of the first fastener 226 is shorter than the shaft 224 of the second fastener 228.

The first and second fasteners 226 and 228 may comprise nut and bolt assemblies, thread-rolling screws, or a combination thereof. In the embodiment shown in FIG. 28, the first and second fasteners 226 and 228 are both bolt and nut assemblies, with the bolt having a thin and flat head 222. In other embodiments, one or both of the fasteners 226 and 228 may comprise carriage bolt and nut assemblies or thread-rolling screws. Preferably, the fasteners 220 do not include any washer.

Figure 29:
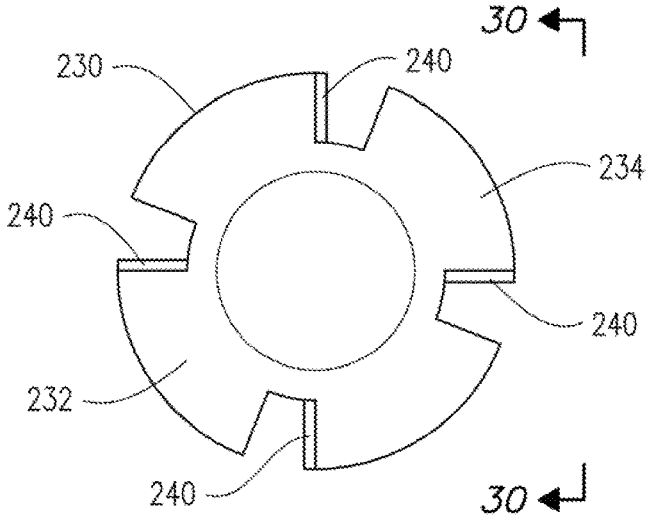
FIG. 29 is a front elevation view of a washer.
Figure 30:
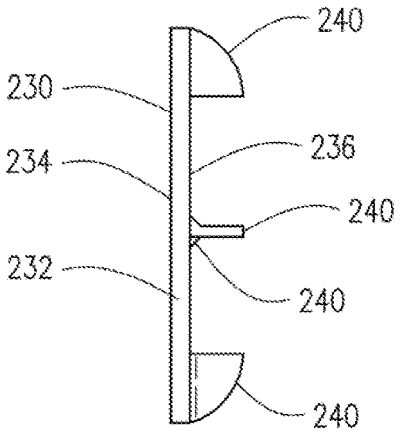
FIG. 30 is a side elevation view of the washer shown in FIG. 29, taken along line 30-30.

In another embodiment, each of the fasteners 220 further comprises a washer 230, shown in detail in FIGS. 29 and 30. The washer 230 is preferably formed as a separate piece from the head 222 and shaft 224. The washer 230 comprises an annular body 232 having an upper surface 234 and an opposed lower surface 236. A central opening 238, circular in shape, is sized to closely but clearingly receive the shaft 224 upon which it will be installed. The diameter of the opening 238 should be less than the maximum cross-sectional dimension of the head 222.

The upper surface 234 of the washer 230 is preferably smooth, and engages the smooth underside of the head 222. The lower surface 236 of the washer 230, on the other hand, is not smooth. Instead, the lower surface 236 is punctuated by a plurality of sharpened teeth 240 that can engage the fabric of an infill section 20. Each tooth 240 projects only from the lower surface 236 and preferably extends only within the footprint of the body 232.

Each tooth 240 is preferably formed by scoring the body 232 and folding away a sharpened tab that extends adjacent the lower surface 236, preferably in orthogonal relationship thereto. In the embodiment shown in the Figures, four teeth 240 are formed. The teeth 240 have uniform angular spacing about the center of the body 232.

To install each fastener 220, the shaft 224 is first inserted through a fastener opening formed in an arm of the bracket 198, as shown in FIG. 28. Specifically, the shaft 224 of the first fastener 226 is inserted through the fastener opening 214 of the first arm 212. The shaft 224 of the second fastener 228 is similarly inserted through the fastener opening 214 of the second arm 216. If the fastener 220 includes a washer 230, the washer 230 is first placed on the shaft 224 and positioned immediately beneath the head 222 before insertion of the shaft 224.

FIGS. 31, 32, 33 and 34 show installation of an infill section 20 on the framework 16 that will form the barrier 10. A rail 26 forming the uppermost part of the framework 16 has an upper side 242 and an adjoining infill side 244. The rail 26 has a face side 246 that joins the upper side 242 and is situated opposite the infill side 244. An infill section 20 to be installed on the framework 16 has an inner side 248 and an opposed outer side 250.

Initially, a tier of at least two rail brackets 198 is partially installed on the infill section 20. The tier should be situated adjacent the uppermost longitudinal edge 194 of the infill section 20. No lower tiers of rail brackets 198 are installed on the infill section 20 at this stage.

Partial installation of a rail bracket 198 is performed by using the first fastener 226 to join the rail bracket 198 to the infill section 20. A washer 230 is installed on the shaft 224 of a first fastener 226, such that its upper surface 234 engages the smooth underside of the head 222. The shaft 224 of the first fastener 226 is then passed through an opening in the infill section 20, starting from its outer side 250. The shaft 224 of the first fastener 226 passes through the fastener opening 214 of the first arm 212. The head 222 of the first fastener 226 presses the teeth 240 of the washer 230 into the fabric of the underlying infill section 20. A nut 252 is installed on the shaft 224 of the first fastener 226 to complete its installation. The second fastener 228 is not installed at this stage of assembly.

Figure 31:
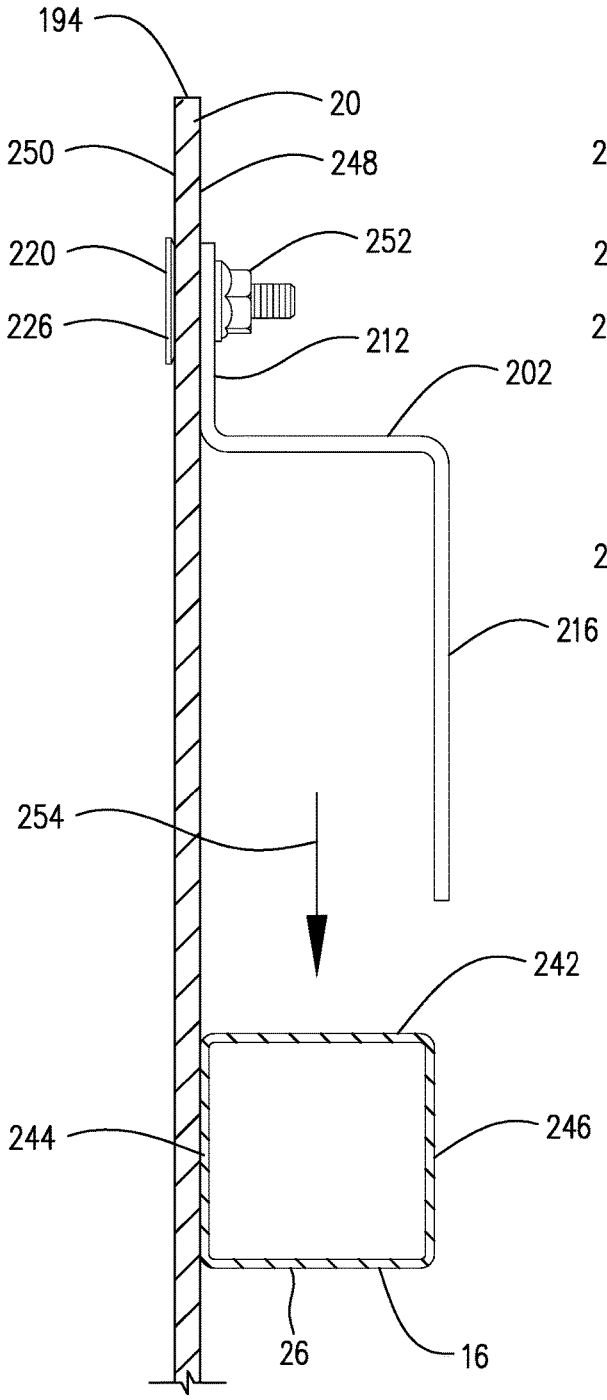
FIGS. 31, 32, 33 and 34 show an upper portion of a framework during successive stages of installation of an infill section.

The infill section 20, with its single tier of partially installed rail brackets 198, is next raised above the framework 16, as shown in FIG. 31. When raised, the seats 202 of the rail brackets 198 are positioned immediately above the upper side 242 of the uppermost rail 26 in the framework 16.

Figure 32:
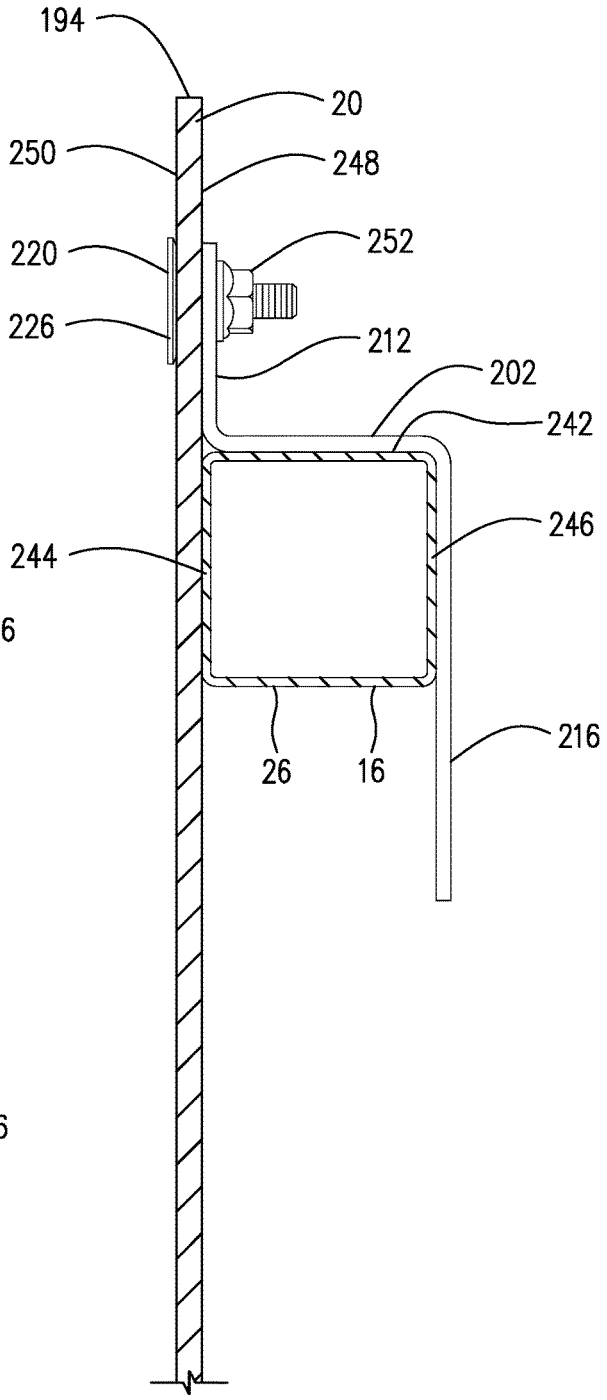

In the next stage of assembly, the raised infill section 20 is lowered in the direction shown by the arrow 254 in FIG. 31. Because the second fastener 228 has not yet been installed, there is no obstacle to seating each rail bracket 198 atop the uppermost rail 26. The infill section 20 is lowered until the seat 202 of each rail bracket 198 rests against the uppermost side 242 of the uppermost rail 26, as shown in FIG. 32.

In the next stage of assembly, a second fastener 228 is installed on each rail bracket 198 in the upper tier. A washer 230 is installed on the shaft 224 of a second fastener 228, such that its upper surface 234 engages the smooth underside of the head 222. The shaft 224 of the second fastener 228 is then passed through an opening in the infill section 20, starting from its outer side 250. The shaft 224 of the second fastener 228 passes through the fastener opening 218 of the second arm 216. The head 222 of the second fastener 228 presses the teeth 240 of the washer 230 into the fabric of the underlying infill section 20. A nut 256 is installed on the shaft 224 of the second fastener 228 to complete its installation.

Figure 33:
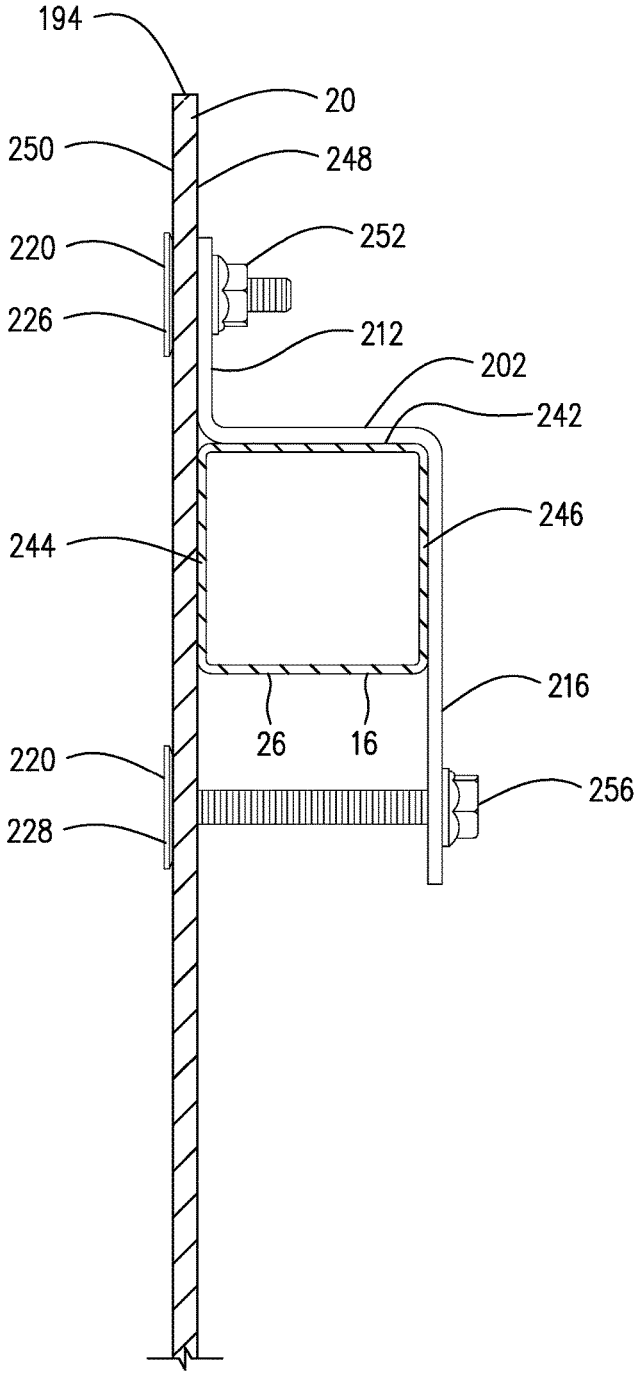
Figure 34:
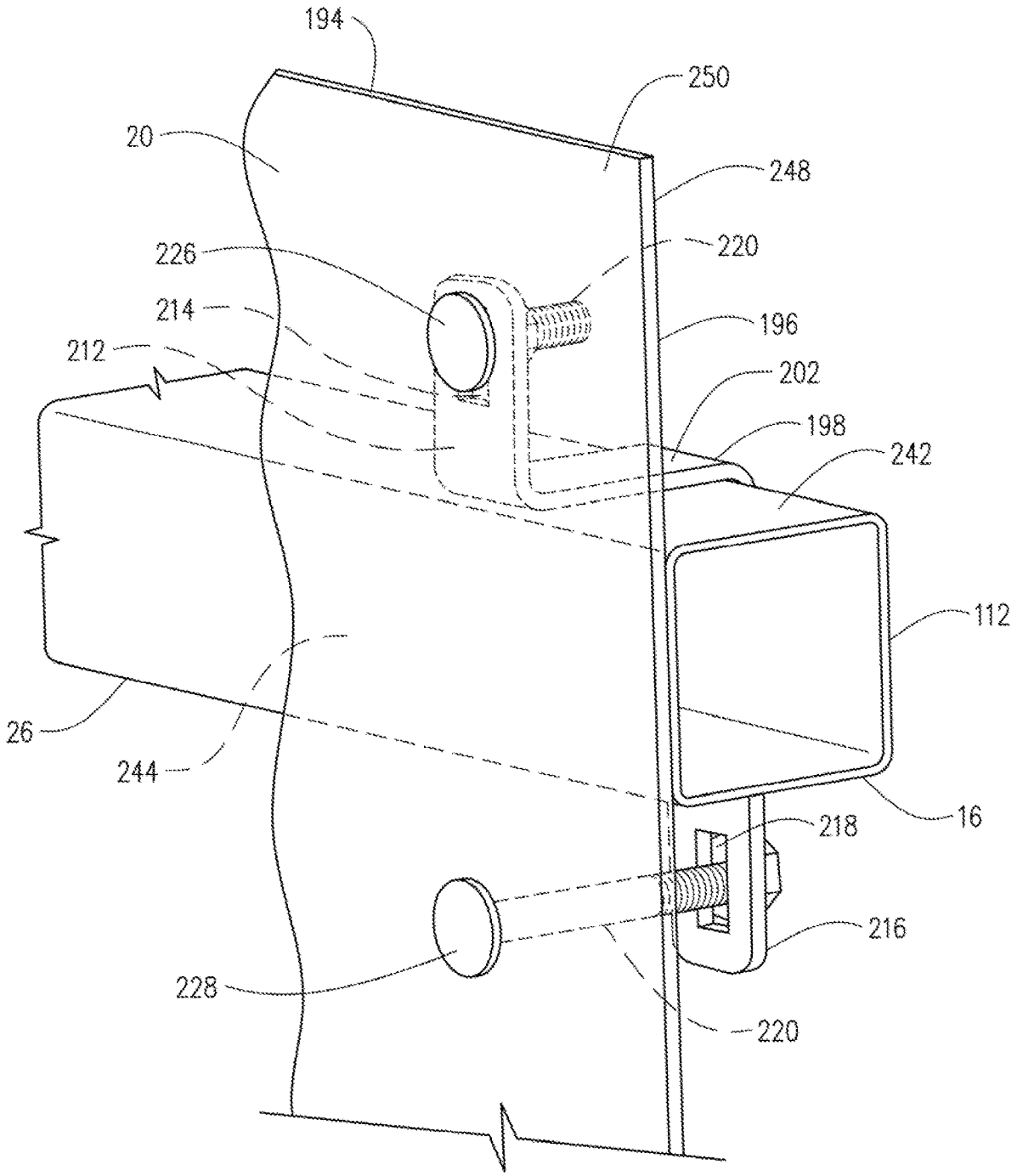

The resulting assembly is shown in FIGS. 33 and 34. The infill section 20 hangs like a curtain from the uppermost rail 26 in the framework 16. Suspension of the infill section 20 in this way assures easier installation of the remaining rail brackets 198 and fasteners that will join the infill section 20 to the framework 16. Further manipulation of the infill section 20 is not required during installation of these additional components.

To install each remaining rail bracket 198, the inner side 248 of the infill section 20 is pressed flush against the infill side 244 of a rail 26. A rail bracket 198 is placed on the rail 26, such that the lower side 210 of the seat 202 engages the upper side 242, and such that the second arm 216 engages the face side 246. With the rail bracket 198 thus placed, its first arm 212 engages the inner side 248 of the infill section 20. The first and second fasteners 226 and 228 are then installed as described above.

The foregoing steps first seat a rail bracket 198 in a stable position atop a rail 26. The seated rail bracket 198 is then attached by fasteners 220 to the infill section 20 at two different points. As a result, there is no direct attachment between the rail 26 and the infill section 20. The teeth 240 of the washer 230 beneath the head 222 of each fastener 220 bite into the fabric of the underlying infill section 20, thereby enhancing the resistance of the infill section 20 to removal or dislodgement.

In some instances, direct attachment of an infill section 20 to a rail 26 forming the framework 16 may be desired, either in a barrier 10 that includes the rail brackets 198, or in a barrier without such rail brackets. Such an installation is shown in FIGS. 35 and 36.

Figure 35:
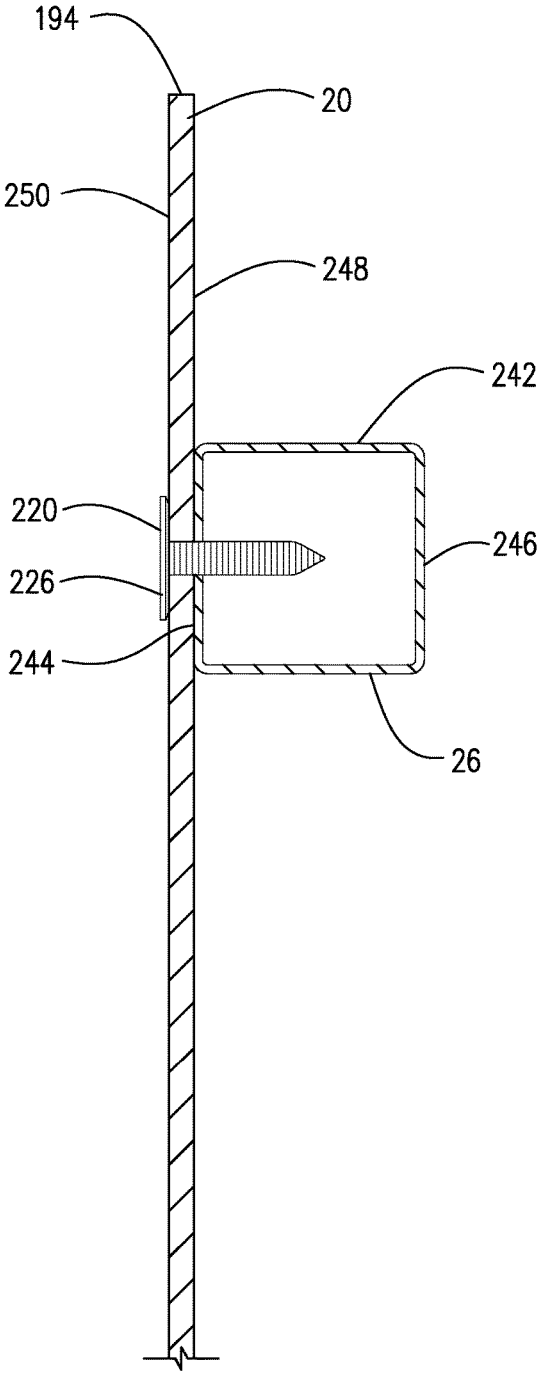
FIG. 35 is a side cross-sectional view of a portion of a barrier, showing an infill section attached directly to a rail.

In FIG. 35, a rail 26 forming part of the framework 16 has an infill side 244. An infill section 20 to be installed on the framework 16 has an inner side 248 and an opposed outer side 250. The inner side 248 of the infill section 20 is pressed flush against the infill side 244 of the rail 26. A washer 230 is installed on the shaft 224 of a first fastener 226, such that its upper surface 234 engages the smooth underside of the head 222. The first fastener 226 shown in FIG. 35 is a thread-rolling screw. The shaft 224 of the first fastener 226 is then passed through an opening in the infill section 20, starting from its outer side 250. The shaft 224 of the first fastener 226 then passes within the rail 26, where it terminates. The head 222 of the first fastener 226 presses the teeth 240 of the washer 230 into the fabric of the underlying infill section 20.

Figure 36:
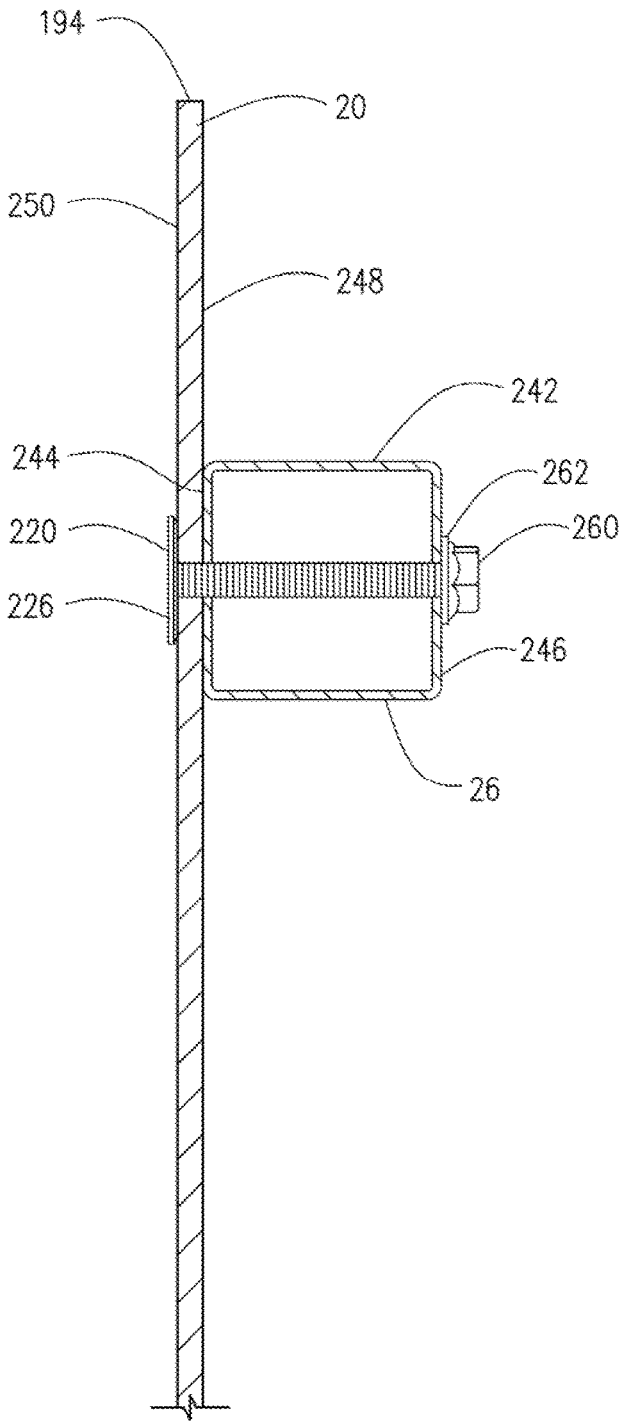
FIG. 36 is a side cross-sectional view of a portion of a barrier, showing an infill section attached directly to a rail. The fastener used to form the attachment is different from the one shown in FIG. 35.
Figure 37:
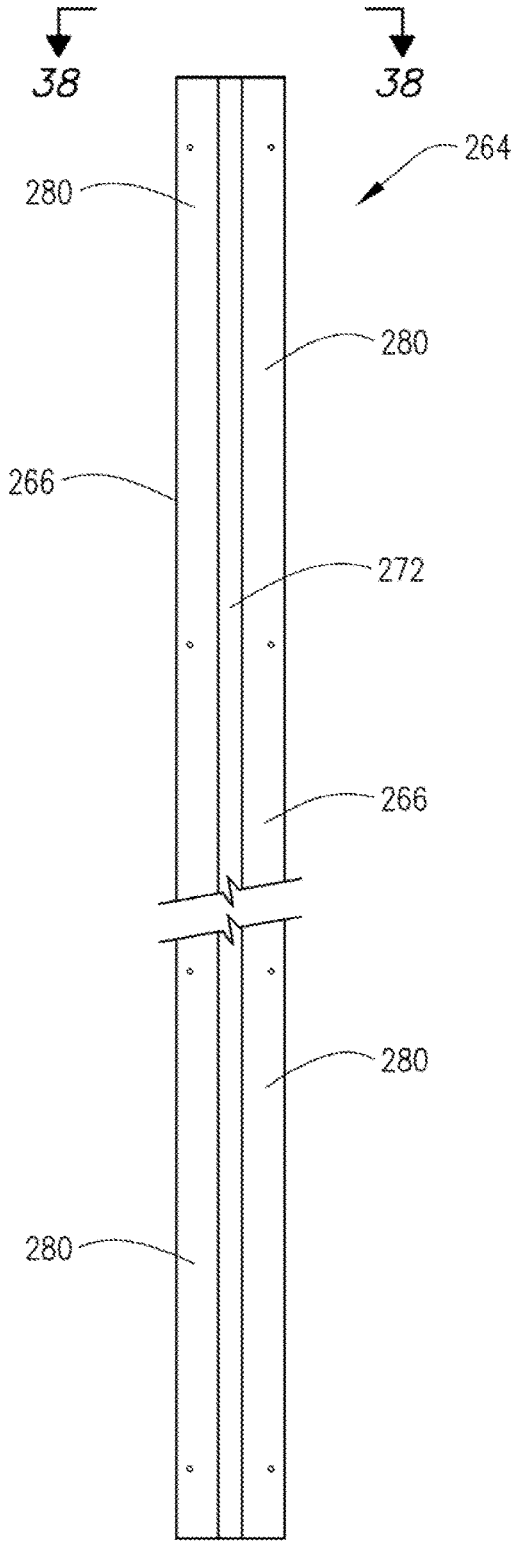
FIG. 37 is a front elevation view of an edge protection band. Broken lines are used to indicate indeterminate length.
Figure 38:
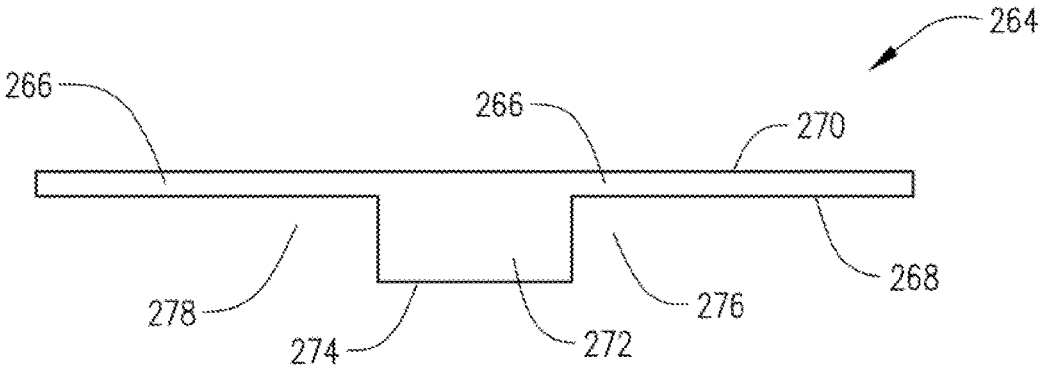
FIG. 38 is a top plan view of the edge protection band shown in FIG. 37, taken along line 38-38.

In FIG. 36, a rail 26 forming part of the framework 16 has an infill side 244 and an opposed face side 246. An infill section 20 to be installed on the framework 16 has an inner side 248 and an opposed outer side 250. The inner side 248 of the infill section 20 is pressed flush against the infill side 244 of the rail 26. A washer 230 is installed on the shaft 224 of a second fastener 228, such that its upper surface 234 engages the smooth underside of the head 222. The second fastener 228 shown in FIG. 36 comprises a nut and bolt assembly. The shaft 224 of the first fastener 226 is then passed through an opening in the infill section 20, starting from its outer side 250. The shaft 224 of the first fastener 226 then passes through the rail 26. The threaded end 258 of the shaft 224 emerges from the face side 246, where it is secured against the rail 26 by a nut 260. A flat washer 262 is installed on the shaft 224 and positioned between the nut 260 and the rail 26.

The foregoing installation steps, which dispense with any rail bracket 198, are repeated until each infill section 20 comprising the barrier 10 is installed, and each opening 18 in the framework 16 is fully covered.

After an infill section 20 is installed on the framework 16, it may present an exposed vertical lateral edge 196. Such an exposed edge 196 can render the infill section 20 vulnerable to tampering, dislodgement or removal. To reduce the likelihood of success for such interference, each exposed vertical lateral edge 196 in the barrier 10 is preferably covered by an edge protection band 264. The edge protection bands 264 included in the barrier 10 are preferably identical in size, shape and construction. Once such edge protection band 264 is shown in FIGS. 31-34.

The edge protection band 264 is an elongate structure formed from a flat and elongate base 266 having a first side 268 and opposed second side 270. An elongate and centrally disposed ridge 272 is formed on the first side 268. Preferably, the ridge 272 has a flat top 274 extending parallel to the base 266.

A first recess 276 is formed on the first side 268 of the base 266. The first recess 276 is elongate, open and bounded only by the base 266 and the ridge 272. Preferably, the first recess 276 has an L-shaped cross-sectional boundary. A second recess 278 is formed on the first side 268 of the base 266, on the opposite side of the ridge 272 from the first recess 276. Like the first recess 276, the second recess 278 is elongate, open and bounded only by the base 266 and the ridge 272. Preferably, the second recess 278 has an L-shaped cross-sectional boundary. More preferably, the second recess 278 is a mirror image of the first recess 276.

The recesses 276 and 278, ridge 272 and base 266 cooperate to impart a T-shaped cross-section to the edge protection band 264. That cross-sectional shape is preferably uniform along the length of the edge protection band 264. A plurality of longitudinally spaced fastener openings 280 are formed on each side of the ridge 272. Each fastener opening 280 penetrates the edge protection band 264.

The edge protection band 264 is preferably formed from a strong and durable material, and more preferably from a material that is relatively lightweight and extrudable as well. In one embodiment, the edge protection band 264 is formed from aluminum, either in elemental or alloyed form. Preferably, the edge protection band 264 is formed as a single piece, and by extrusion.

Figure 39:
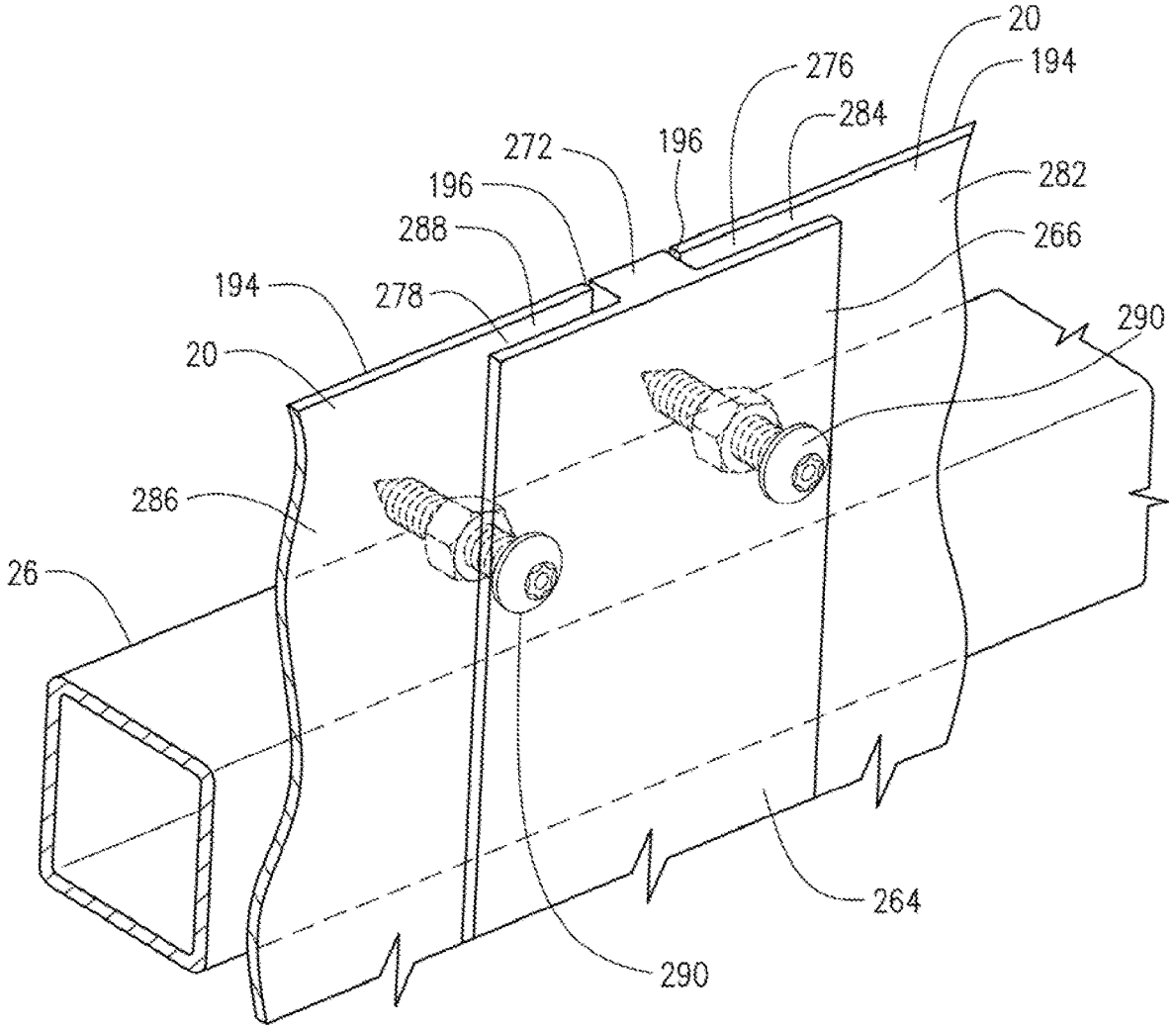
FIG. 39 is an enlarged perspective view of the upper portion of an edge protection band, in an installed configuration within a barrier.
Figure 40:
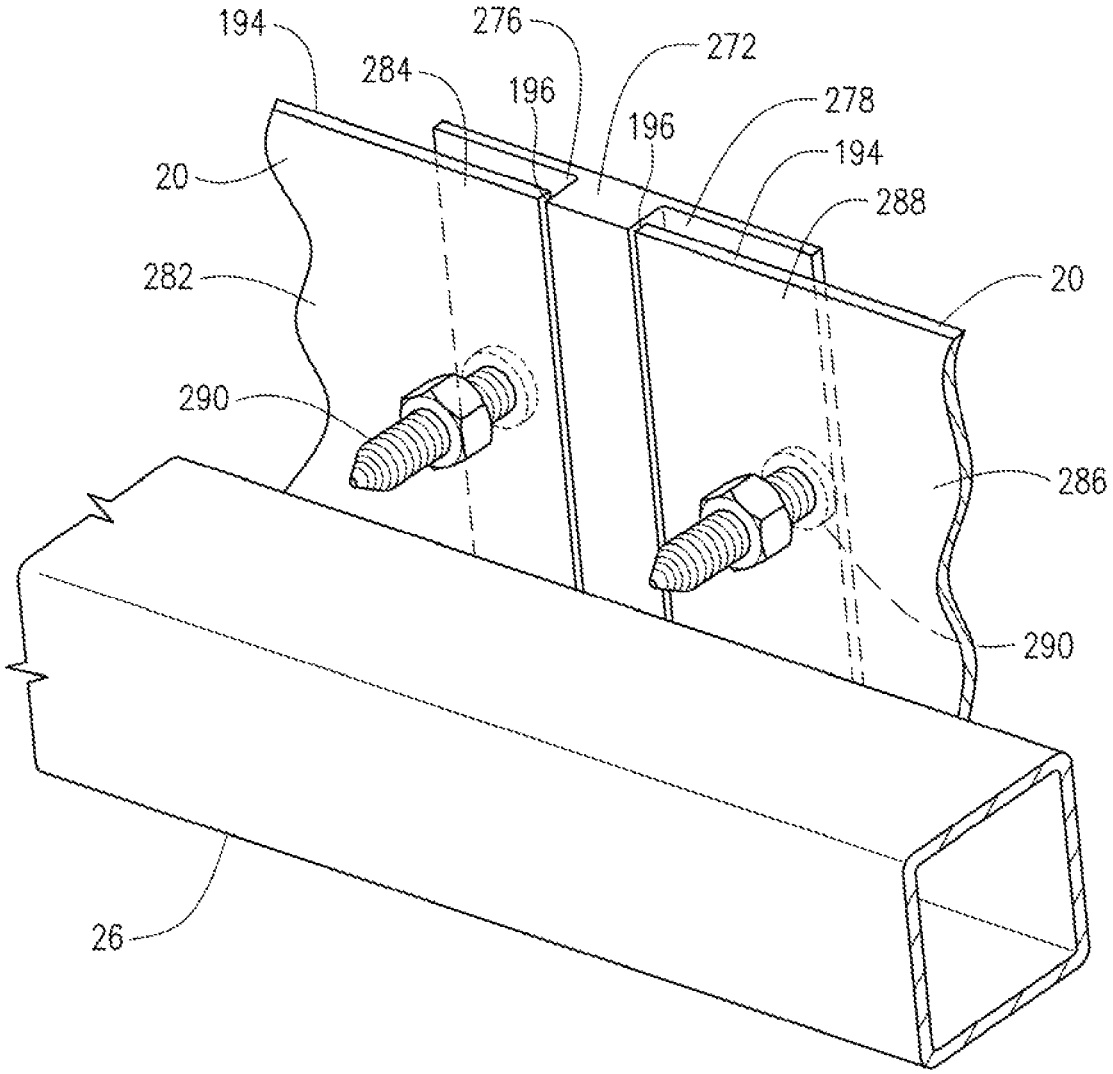
FIG. 40 is another enlarged perspective view of the upper portion of the edge protection band shown in FIG. 39, again in an installed configuration within a barrier. The view is taken from the opposite side of the barrier from the view taken in FIG. 39.

FIGS. 39 and 40 show installation of an edge protection band 264 onto a portion of a framework 16 that supports two adjoining infill sections 20. A first infill section 282 has a first lateral edge portion 284, and an adjacent second infill section 286 has a second lateral edge portion 288. An edge protection band 264 is oriented vertically, and positioned such that the ridge 272 faces downward, and engages the framework 16. Preferably, the ridge 272 engages the framework 16 only at its rails 26.

The first lateral edge portion 284 of the first infill section 282 is received within the first recess 276 and situated between the edge protection band 264 and the framework 16. The second lateral edge portion 288 of the second infill section 286 is received within the second recess 278 and situated between the edge protection band 264 and the framework 16.

Once the edge protection band 264 is positioned as required, fasteners 290 are installed in the fastener openings 280, in order to secure the edge protection band 264 to the framework 16. The shaft of each fastener 226 passes through the edge protection band 264 and through the underlying infill section. A nut secures the fastener 290 against the infill section adjacent the end of its shaft.

The foregoing steps are repeated with an additional edge protection band 264 at each site on the framework 16 at which an infill section 20 presents an exposed vertical lateral edge 196. When two adjacent exposed edges 196 are presented at a site, each recess of the band 264 receives an edge portion of one of the infill sections 20. When a single exposed edge 196 is presented at a site, only one of the recesses of the band 264 is used.

Most components of the barrier 10, including posts 22, infill sections 20, rails 26, post brackets 28 and 62, connectors 106, cladding elements 186 and rail brackets 198, are preferably formed from a strong and durable material, such as steel. In one embodiment, this steel is ASTM A36 steel. To enhance its resistance to corrosion, the steel is preferably hot dip galvanized after being formed into the required shape. In some instances, the steel may be pregalvanized before the component is formed.

Several kits are useful for assembling a barrier 10. A first kit comprises a plurality of post brackets 62, a plurality of posts 22 and a plurality of rails 26. A second kit comprises a plurality of rails 26 and a plurality of adapters 120. A third kit comprises a plurality of rails 26 and a plurality of rail brackets 198. A plurality of fasteners 220 may be added to the third kit. A fourth kit comprises a plurality of frame components 14, a plurality of infill sections 20, and a plurality of fasteners 220. A fifth kit comprises a plurality of frame components 14, a plurality of infill sections 20, and a plurality of edge protection bands 264. Additional components of the barrier 10 may be added to any of these kits.

Unless otherwise stated herein, any of the various parts, elements, steps and procedures that have been described should be regarded as optional, rather than as essential. Changes may be made in the construction, operation and arrangement of these parts, elements, steps and procedures without departing from the spirit and scope of the invention as described in the following claims.

The invention claimed is:

1. A barrier, comprising:

a framework formed from a plurality of spaced apart posts and a plurality of spaced apart rails; and a kit, comprising:

a plurality of edge protection bands, each comprising:

a flat and elongate base having opposed first and second sides, the second side having no channel formed therein;

an elongate and centrally disposed ridge formed on the first side, the ridge having a flat top extending parallel to the base;

first and second recesses formed on the first side of the base and on opposite sides of the ridge, in which each recess is elongate, open and bounded only by the base and the ridge;

a plurality of fastener openings formed in the base on opposite sides of the ridge; and a plurality of fasteners, each fastener extending through a corresponding one of the fastener openings; and a plurality of infill sections;

the kit being arranged such that:

one of the plurality of edge protection bands is situated such that its ridge engages the framework;

a first infill section from the plurality of infill sections is supported by the framework and configured to cover all or part of one or more openings in the framework, the first infill section having an edge portion that is received within the first recess of the said one edge protection band and is situated between the edge protection band and the framework; and a second infill section from the plurality of infill sections is supported by the framework and configured to cover all or part of one or more openings in the framework, the second infill section having an edge portion that is received within the second recess of the said one edge protection band and is situated between the edge protection band and the framework.

2. The kit barrier of claim 1 in which each recess of each edge protection band has an L-shaped cross-sectional boundary.

3. The barrier of claim 1 in which the ridge of the edge protection band engages the framework only at its rails.

4. The barrier of claim 1 in which each post in the framework is embedded within a terrain at and adjacent one of its ends.

5. The barrier of claim 1 in which each of the plurality of rails is tubular.

6. The barrier of claim 1 in which each of the plurality of posts is elongate and tubular.

7. The barrier of claim 1 in which a surface forming the second side of the base of each edge protection band extends entirely within a single plane.

8. The barrier of claim 1 in which each of the rails has smaller cross-sectional dimensions than each of the posts.

* * * * *